US005908343A

United States Patent [19]

Rothbarth et al.

[11] Patent Number: 5,908,343

[45] Date of Patent: Jun. 1, 1999

[54] KINETIC TOY

[76] Inventors: James N. Rothbarth, 11880 Conway Rd.; Alex Kinming Lee, c/o James N. Rothbarth, Chaos, L.L.C., 11880 Conway Rd., both of St. Louis, Mo. 63131-6413

[21] Appl. No.: 08/934,435

[22] Filed: Sep. 19, 1997

Related U.S. Application Data

[62] Division of application No. 08/719,951, Sep. 24, 1996, Pat. No. 5,709,581.

[51] Int. Cl.[6] ..... A63H 18/00

[52] U.S. Cl. ..... 446/171

[58] Field of Search ..... 446/168, 171; 434/118

[56] References Cited

U.S. PATENT DOCUMENTS

| | | | |
|---|---|---|---|
| 1,260,664 | 3/1918 | Gregory . | |
| 1,320,362 | 10/1919 | Kriegsfield . | |
| 1,400,066 | 12/1921 | Huck . | |
| 1,402,563 | 1/1922 | Bodine et al. | 446/168 |
| 1,714,433 | 5/1929 | Molnar . | |
| 2,000,808 | 5/1935 | Williams | 446/168 |
| 2,726,869 | 12/1955 | Schulte | 446/168 X |
| 3,145,501 | 8/1964 | Grosser | 446/168 X |
| 3,195,267 | 7/1965 | Gehlen | 446/168 |
| 3,278,187 | 10/1966 | Sinden | 273/118 |
| 3,331,143 | 7/1967 | Weisbecker et al. | 434/118 |
| 3,388,483 | 6/1968 | Weisbecker | 35/30 |
| 3,581,987 | 6/1971 | Tomaro | 238/10 E |
| 3,782,724 | 1/1974 | Ernst | 446/171 X |
| 3,782,729 | 1/1974 | Ernst | 273/138 |
| 3,946,516 | 3/1976 | Wirth | 46/17 |
| 3,994,076 | 11/1976 | Bertman | 35/30 |
| 4,128,964 | 12/1978 | Ogasawara | 46/43 |
| 4,171,090 | 10/1979 | Eisenburg | 238/10 R |
| 4,414,629 | 11/1983 | Waite | 364/300 |
| 4,646,238 | 2/1987 | Carlson, Jr. et al. | 364/403 |
| 4,847,784 | 7/1989 | Clancey | 364/513 |
| 4,874,342 | 10/1989 | Klitsner | 446/168 |
| 4,887,218 | 12/1989 | Natarajan | 346/468 |
| 4,924,385 | 5/1990 | Dote | 364/300 |
| 4,932,917 | 6/1990 | Klitsner | 446/168 |
| 4,933,871 | 6/1990 | DeSieno | 364/513 |
| 4,939,680 | 7/1990 | Yoshida | 364/513 |
| 4,964,043 | 10/1990 | Galvin | 364/401 |
| 5,121,330 | 6/1992 | Blaha et al. | 364/468 |
| 5,172,313 | 12/1992 | Schumacher | 364/401 |
| 5,193,182 | 3/1993 | Bachman et al. | 395/600 |
| 5,282,767 | 2/1994 | Gelardi | 446/126 |
| 5,312,285 | 5/1994 | Rieber et al. | 446/168 |
| 5,349,659 | 9/1994 | Do et al. | 395/700 |
| 5,709,581 | 1/1998 | Rothbarth et al. | 446/171 |
| 5,785,573 | 7/1998 | Rothbarth et al. | 446/171 |

*Primary Examiner*—William H. Grieb
*Attorney, Agent, or Firm*—Senninger, Powers, Leavitt & Roedel

[57] ABSTRACT

A kinetic toy in which a ball rolls down a trackway from an upper location to a lower location and is automatically returned to the upper location for recycling, the toy being constructed of individual parts which are readily assembled in various configurations, including frame parts, trackway parts, including ball-operated switch parts, and bracket parts for supporting the trackway on the frame.

16 Claims, 16 Drawing Sheets

KINETIC TOY

This application is a division of our application Ser. No. 08/719,951, filed Sep. 24, 1996, now U.S. Pat. No. 5,709, 581 entitled KINETIC TOY.

BRIEF SUMMARY OF THE INVENTION

This invention relates to a kinetic toy and more particularly to a toy of the rolling ball type in which a ball rolls down a trackway from an elevated upper-level position to a terminal lower-level position, the ball being automatically recycled for operation in cycles, one after another.

Among the several objects of the invention may be noted the provision of a construction toy of the class described made up of individual parts which are readily assembled in various configurations, the toy and its assembly being interesting and amusing to children and adults, and also educational as to scientific and engineering principles, e.g. principles of structural engineering; the provision of such a toy as to which individual parts may be supplied as a kit with the parts quickly and easily assembled without tools, and with instructions, which may be computerized, for the assembly of the parts in various configurations; the provision of a number of different trackway parts and adjuncts for such a toy for construction of a variety of trackways, including construction of a trackway with components for a change in slope of the trackway at one or more points along its length and components for alternating the pathway of the ball on successive cycles.

In general, a kinetic toy of this invention is constructed of a plurality of individual parts and comprises a frame comprising a plurality of frame members and connectors interconnecting ends of the frame members, the frame members and connectors being constructed for quick assembly thereof, and the frame being adapted to stand upright on a generally horizontal supporting surface. A trackway for the ball is supported by the frame for travel of the ball by rolling down the trackway from an elevated position at an upper level with respect to the frame to a terminal position at a lower level with respect to the frame. The trackway comprises a plurality of individual track members assembled end-to-end and constructed for quick assembly end-to-end. Means supported by selected frame members supports the trackway for the travel of the ball, being constructed for quick assembly with said selected frame members and being constructed for quick assembly of selected track members therewith. An elevator assembled with the frame has components constructed for quick assembly with selected members of the frame, said elevator having a lower end positioned at said terminal position for receiving the ball after its descent down the trackway and an upper end at said elevated position for raising the ball to said elevated position for ensuing travel of the ball down said trackway, means being provided for driving said elevator. A kit of parts for assembly of the toy includes a variety of frame members, connectors for quick assembly of the frame members in various configurations, a variety of tracks including straight and curved tracks for assembly to form the trackway in various configurations, brackets adapted to be mounted on frame members for supporting the tracks, components for assembly to form the elevator, and means for constructing the trackway with diverse routes for the ball comprising ball-operated means for switching from one route to another on alternate descents of the ball.

Other objects and features will be in part apparent and in part pointed out hereinafter.

BRIEF DESCRIPTION OF THE DRAWINGS

Corresponding reference characters indicate corresponding parts throughout the views of the drawings.

DETAILED DESCRIPTION

Figure 1:
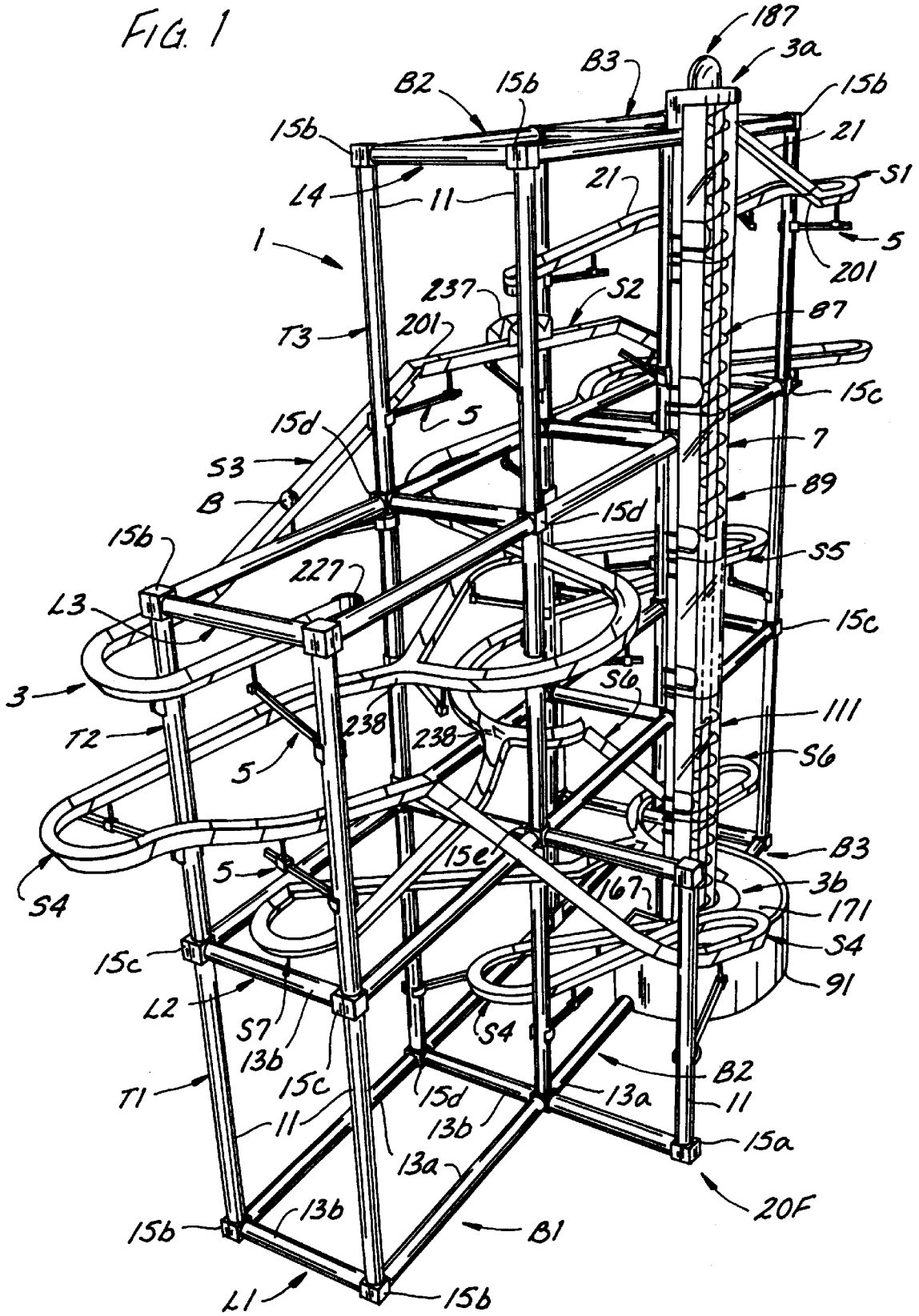
FIG. 1 is a view in perspective of a kinetic toy of this invention as constructed in one configuration, and as viewed from what may be referred to as the front of the construction.
Figure 2:
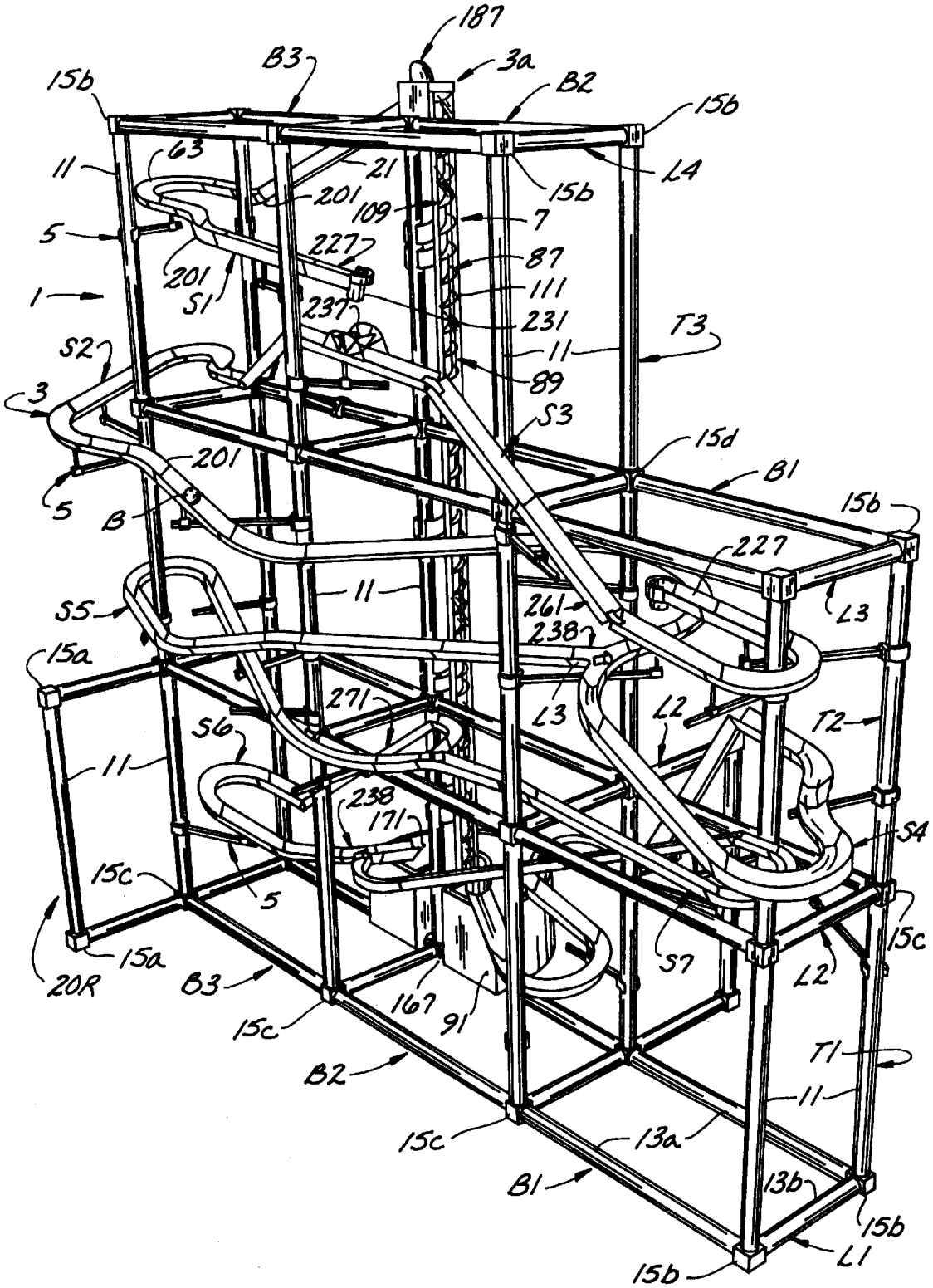
FIG. 2 is a view in perspective of the toy as viewed from what may be referred to as the back or rear of the construction.
Figure 31:
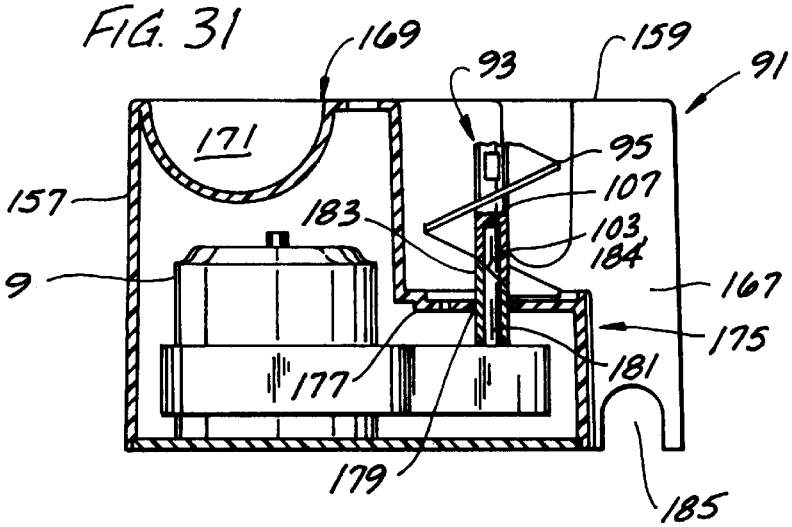
Figure 32:
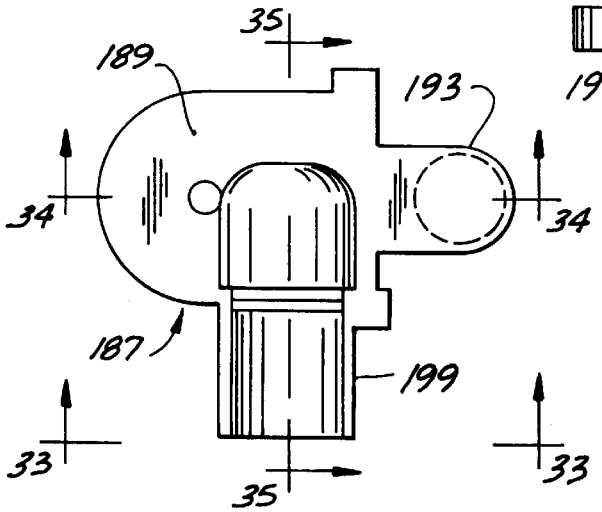
FIG. 32 is a plan view of a top for the elevator such as used in the construction.
Figure 33:
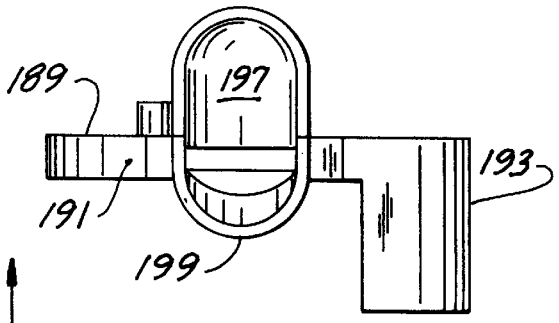
FIG. 33 is a view in side elevation of the elevator top shown in FIG. 32 as viewed on line 33—33 of FIG. 32.
Figure 35:
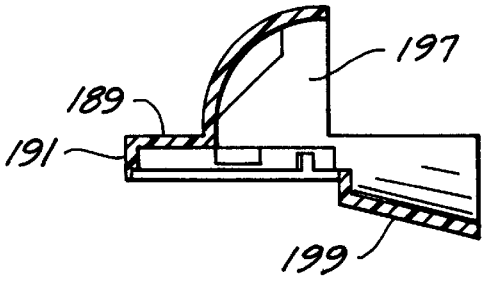
FIGS. 34 and 35 are enlarged vertical sections taken generally on lines 34—34 and 35—35 of FIG. 32.

Referring to the drawings, first more particularly to FIGS. 1 and 2, a toy of this invention constructed of a plurality of individual parts detachably connected together is shown to comprise a frame designated in its entirety by the reference numeral 1 comprising a plurality of individual frame members and connectors interconnecting ends of the frame members, the frame members and connectors being constructed for quick assembly thereof without tools to form the frame, said frame being adapted to stand upright on a generally horizontal supporting surface such as the floor of a room or a table. A trackway designated in its entirety by the reference numeral 3 is supported by the frame for travel of a ball B by rolling down the trackway from an elevated starting position indicated generally at 3*a* at an upper level with respect to the frame (at the upper end of the trackway) to a terminal position 3*b* at a lower level with respect to the frame (at the lower end of the trackway). As will be described in detail, the trackway comprises a plurality of track members assembled end-to-end and constructed for quick assembly end-to-end without tools. Means such as generally indicated at 5 supported by selected frame members supports the trackway for the travel of the ball, this means being constructed for quick assembly with said selected frame members, said track members being constructed for quick assembly of selected track members with said trackway supporting means. An elevator indicated generally at 7 assembled with the frame has components constructed for quick assembly with each other and with selected members of the frames, having a lower end positioned at said terminal ball position 3*b* for receiving the ball after its descent down the trackway and an upper end at said elevated starting position 3*a* of the ball for delivery of the ball to said elevated position 3*a* for ensuing travel (rolling) of the ball down the trackway. At 9 (see FIG. 31) is indicated means constituted by an electric motor for continuously driving the elevator when the toy is placed in operation.

The frame 1 is built up of a plurality of frame members each designated 11 constituting columns of the frame, a plurality of frame members each bearing the generic reference numeral 13 constituting beams (crossbeams) of the frame and a plurality of connectors (corner pieces) each bearing the generic reference numeral 15, the columns, beams and connectors being constructed for quick assembly (quick connection) thereof with the connectors at the meeting ends (corners) of the columns and beams, with the columns extending generally vertically in horizontally spaced relation and held in such position by the beams. As herein illustrated, each of the columns 11 is constituted by a tube, more particularly a length of relatively thin-walled high impact polystyrene (HIPS) tubing of circular cross section, e.g. a tube 13.5 inches long, having an outside diameter (OD) of 18.5 mm and an inside diameter (ID) of 16 mm. Each of the beams 13 is also constituted by a tube, more particularly a length of the same tubing as the columns. The beams are supplied in two lengths; long beams 13*a* (e.g. 13.5 inches long) and short beams 13*b* (e.g. 6.75 inches long). The corner connectors are all generally alike in comprising a cubic block designated 17 with extensions 19 (see FIG. 3) of cruciform cross-section from a number of sides of the block adapted for a frictional fit in the ends of the tubular columns and beams, each extension having a tapered end 20. As appears in FIGS. 1 and 2 there are several types of corners and several types of corner connectors, as follows:

(1) connectors 15*a* having the cruciform extensions 19 from two sides of the cubic block 17 thereof for a corner where one beam and one column are joined together with the beam and column at right angles to one another;

(2) connectors 15*b* having the cruciform extensions 19 from three faces of the cubic block 17 thereof for a corner where two beams and one column are joined together with the beams at right angles to one another in a horizontal plane and the column extending vertically;

(3) connectors 15*c* having the cruciform extensions 19 from four faces of the cubic block where two beams and two columns are joined together with the beams at right angles to one another and one column extending vertically up and the other vertically down from the corners or where three beams and one column are joined together;

(4) connectors 15*d* having the cruciform extensions 19 from five faces of the cubic block where three beams and two columns are joined together with two of the beams in horizontal alignment extending from the block in a horizontal plane and the third beam extending from the block at right angles to said two beams, and with the columns in vertical alignment one extending up and the other down from the corner; and (5) connectors 15*e* having the cruciform extensions 19 from all six faces of the cubic block where four beams and two columns are joined together with the four beams extending out horizontally in four directions and the columns in vertical alignment one extending up and the other down from the corner Only connector 15*e* (the connector with six extensions 19) is detailed in the drawings (FIG. 3), and how the connectors 15*a*–15*d* are configured may be readily deduced therefrom. The number of corner parts for a kit may be reduced by supplying only parts 15*d* and 15*e*.

Figure 3:
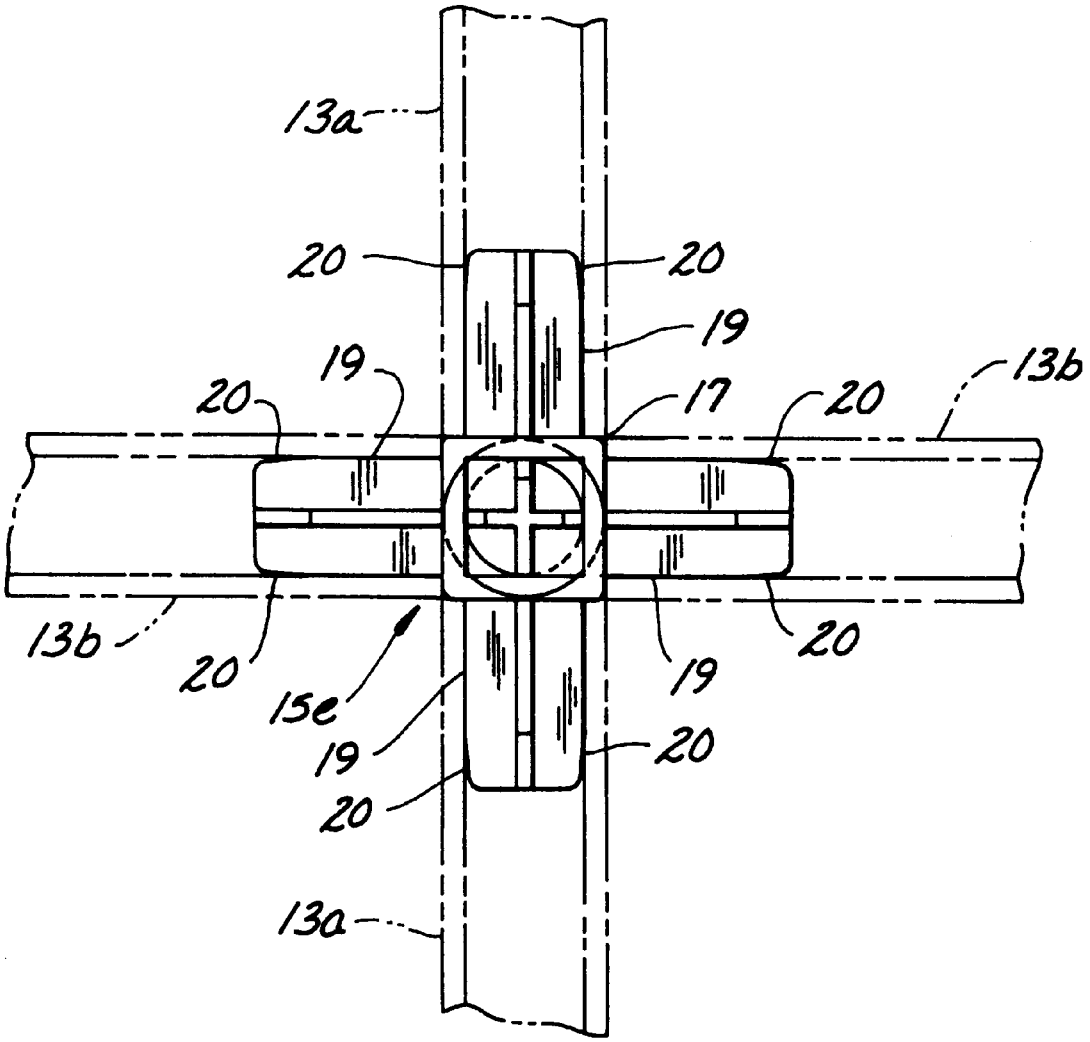
FIG. 3 is a view of a connector for certain columns and beams of the construction, showing in phantom four beams and a column interconnected thereby.

The corner connectors 15*a*–15*e* are preferably molded of a high impact plastic, such as an acrylonitrile, butadiene and styrene copolymer (ABS), with the extensions 19 thereof of the cruciform cross-section as illustrated in FIG. 3 dimensioned for a sliding frictional fit in the ID of the tubular columns 11 and beams 13*a*, 13*b*. The aforementioned kit of parts may include a suitable number and variety of the frame and corner parts for erection of a frame in various configurations, the frame herein illustrated in FIGS. 1 and 2 comprising a first three-bay tier indicated generally at T1 constituting the lower tier of the frame, a second three-bay tier indicated generally at T2 above the lower tier constituting the intermediate tier of the frame, and third a two-bay tier indicated generally at T3 above the second tier constituting the upper tier of the frame. The bays are indicated generally at B1, B2 and B3; it will be observed that the upper tier T3 comprises only two bays, namely bays B2 and B3. The elevator 7 extends heightwise on one face of the frame which may be referred to as the front of the frame, the other face therefore being referred to as the rear of the frame. The frame may be described as having a bottom level L1, a second level L2, a third level L3 and a top level L4. At each of levels L1, L2 and L3 it comprises a front series of three long beams 13*a* and a rear series of three long beams 13*a* connected end-to-end by appropriate connectors 15, and three short beams 13*b* extending front-to-rear between connectors 15 at the ends of the long beams. At level L4, the frame includes a front series of two long beams 13*a* and a rear series of two long beams 13*a* connected end-to-end by appropriate connectors 15, and three short beams 13*b* extending front-to-rear between the connectors 15 at the ends of the long beams at said level L4. In each of tiers T1 and T2 there are four columns at the front and four at the back extending vertically between the connectors 15 which interconnect the beams at levels L1, L2 and L3. In tier T3, there are three columns at the front and three at the rear extending vertically between the connectors 15 which interconnect the beams at levels L3 and L4. The frame 1 is shown as it appears standing upright on the aforesaid generally horizontal supporting surface such as a floor, the blocks 17 of the corner connectors 15 at the bottom of the frame (the corner connectors at the bottom level L1) bearing on said surface. Outrigger constructions such as generally indicated at 20F and 20R each assembled from one of the column members, two of the short beams and two corner connectors, are provided at the front and rear of the frame for keeping it from tipping over.

Figures 4, 5, 6, 7, 8, 9, 9A:
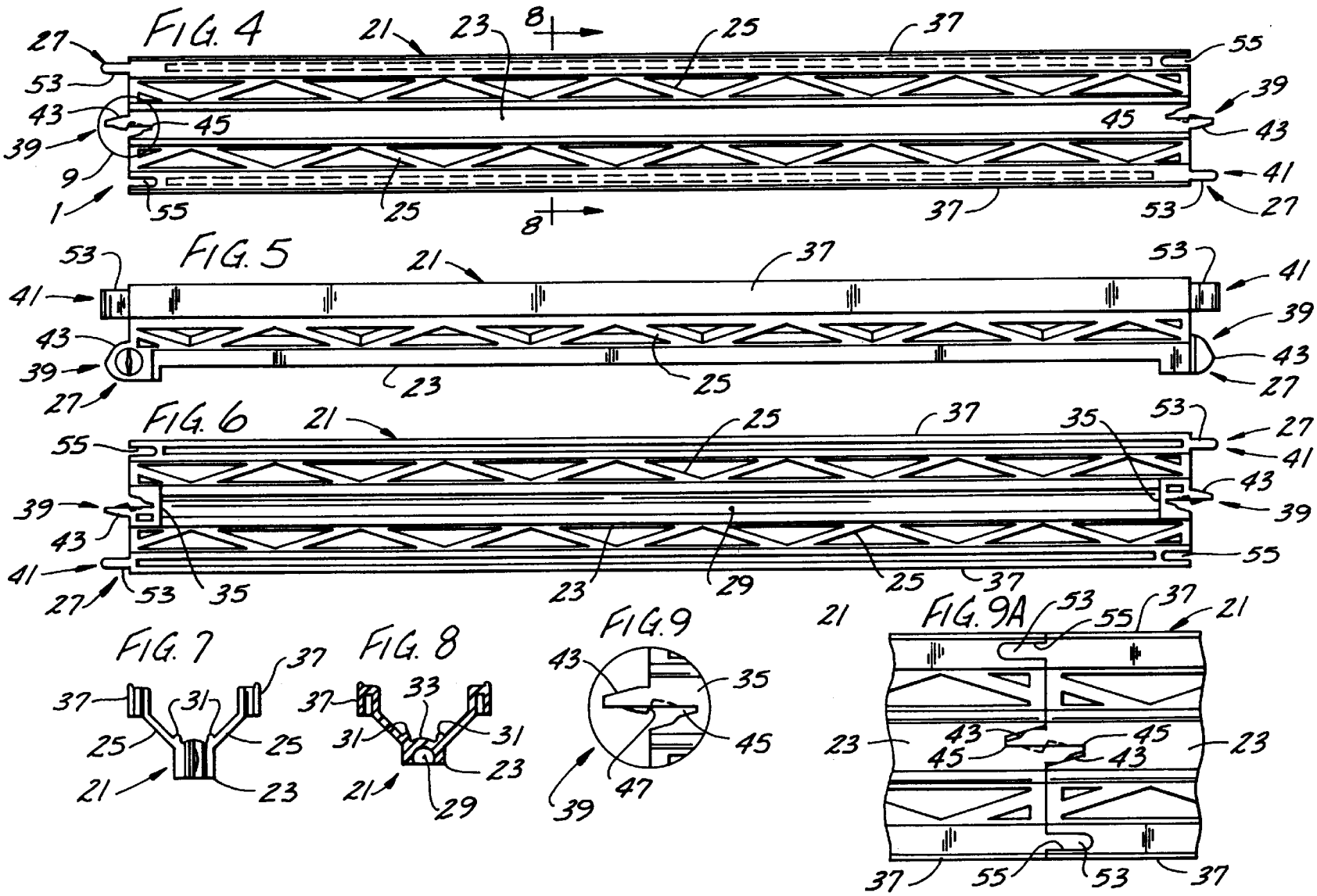
FIG. 4 is top plan view of a part referred to as a straight track such as used in the construction, shown per se.
FIG. 5 is a side elevation of the FIG. 4 track.
FIG. 6 is a bottom plan view of the FIG. 4 track.
FIG. 7 is an end view of the FIG. 4 track (the right end as viewed in FIG. 4)
FIG. 8 is a transverse section of the FIG. 4 track generally on line 8—8 of FIG. 4.
FIG. 9 is an enlarged fragment of FIG. 4.
FIG. 9A is a view on a larger scale than FIG. 9 showing the end-to-end connections of two tracks.

As noted above the trackway 3 comprises a number of types of individual track members which are assembled end-to-end and constructed for quick assembly end-to-end without tools. As herein illustrated, one type of track member, referred to as the long track, is shown per se in FIGS. 4–9, designated in its entirety by the reference numeral 21. This track comprises an elongate molded plastic member, preferably molded of ABS plastic, generally of V-shape in cross section, (see FIGS. 7 and 8) having a rail 23 extending the length thereof at the bottom and sides each designated 25 extending up from the bottom rail 23 diverging in upward direction, each at an angle of about 45° off vertical. As seen in FIGS. 4–6, the sides 25 are triangulated, in the configuration of a Warren truss having parallel upper and lower chords. Means designated in its entirety by the reference numeral 27 is provided at each end of the elongate member for quick connection thereto end-to-end of another track of similar construction. The elongate member is molded with a downwardly opening groove 29 in the bottom rail 23, this groove in cross-section as shown in FIG. 8 being of arcuate form, extending on an arc of somewhat greater than 180° so that its width at the bottom is somewhat greater than the width just above the bottom for a purpose that will appear. This groove may be referred to as an undercut groove. The bottom rail has upper side portions 31 extending slightly above a curved portion 33 adjacent the top of the rail, forming spaced rail heads on which the ball rolls. The groove 29 extends somewhat less than the full length of the lower rail 23, the latter having end heads each designated 35 at the ends of the groove. The track 21 further has upper rails each designated 37 at the upper edges of the inclined sides 25 of the track, each of these upper rails, as appears in FIGS. 7 and 8, being generally of inverted channel shape in transverse cross section, substantially throughout their length.

The aforementioned means for quick connection to a track 21 of another track 21 of similar construction in end-to-end relation comprises snap-fit means indicated generally at 39 at the ends of the lower rail 23 and friction fit means indicated generally at 41 at the ends of the upper rails 37. The snap-fit means comprises a projection 43 of semicircular shape as viewed from either side of the track 21 extending endwise outwardly from the end head 35 of the lower rail at each end of the track. The projection 43 at each end of the lower rail is of tapered conformation tapering outwardly from the respective end head, thus being generally of wedge shape in plan as appears in FIG. 9. The track 21 is molded with a recess 45 in each end head 35 extending inwardly from the respective outer end of the track, this recess having a shape complementary to the shape of the projection or wedge 43. The latter overlaps (partially blocks) the recess 45 thereby providing a shoulder 47 at the outer end of the recess engageable by the shoulder of a projection or wedge 43 inserted in the recess. Here it may be noted that, with the track 21 molded of suitable plastic, the end head 35 is adapted to widen on insertion of the wedge 43, thus permitting the insertion. As appears in FIGS. 4 and 6, the projection or wedge 43 at one end of the track is at the opposite side of the recess 45 at that end of the track from the arrangement at the other end.

The friction fit means 41 (which assists in maintaining the end-to-end alignment of tracks 21 assembled end-to-end) comprises a tongue 53 (preferably a split tongue) extending outwardly endwise from one end of one of the upper rails 37 and a recess 55 in the other end of said one upper rail track a similar but oppositely arranged tongue and recess at the other end of the track. The tongues are molded for a friction fit in the recesses 55. As appears in FIGS. 4 and 6, the tongues and recesses are arranged oppositely at the ends of the upper rails, i.e., at the left end of the track as viewed in FIG. 4 the tongue 53 is on the rail 37 at the top of the left end of the view and the recess 55 is in the rail 37 at the bottom of the left end of the view, and at the right end of the view, the relationship is reversed. The arrangement is such tat on assembly of two tracks 21 end-to-end, the tongue 53 at the end of one track is entered with a friction fit in the recess 55 at the respective end of the other track, and the tongue of said other track is entered with a friction fit in the recess at the respective end of said one track.

Figure 12:
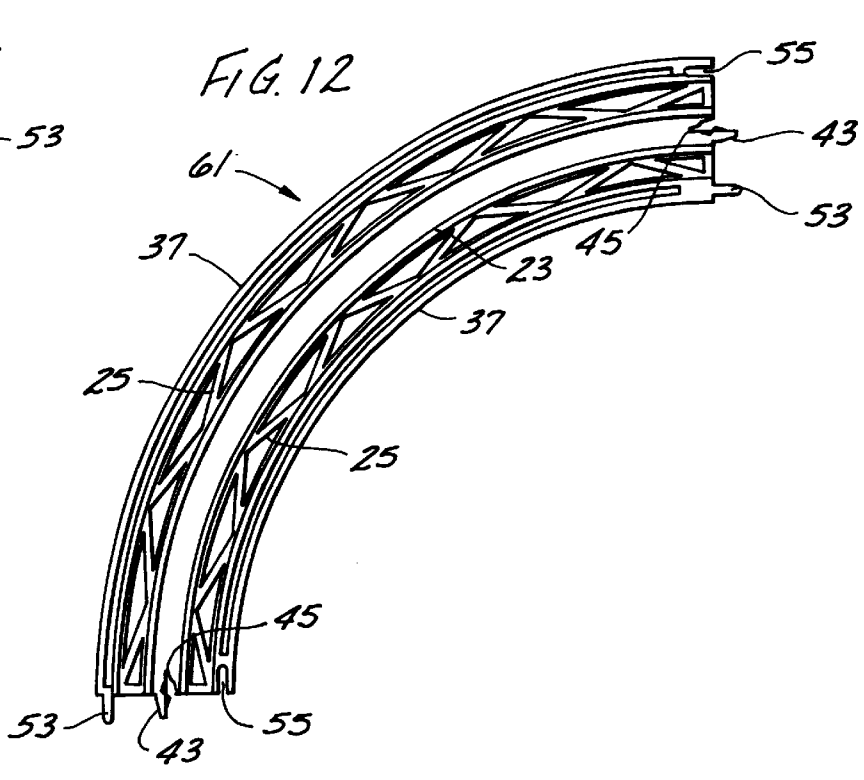
FIG. 12 is a top plan view of a 90° curved track such as used in the construction, on a smaller scale than FIG. 10.
Figure 10:
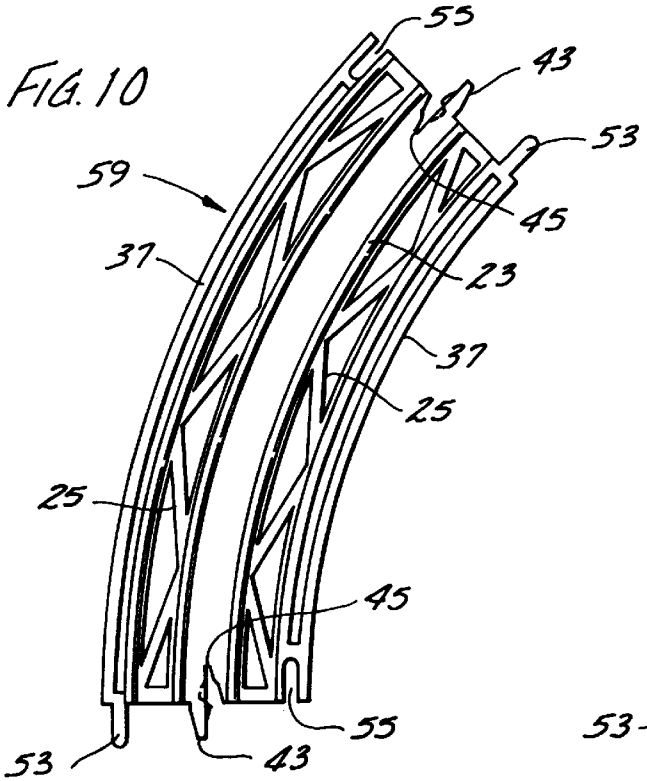
FIG. 10 is a top plan view of a 45° curved track such as used in the construction, on a larger scale than FIG. 4.
Figure 13:
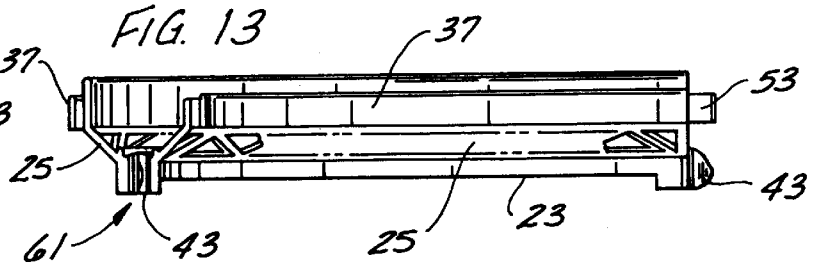
FIG. 13 is a side elevation of the FIG. 12 track.
Figure 11:
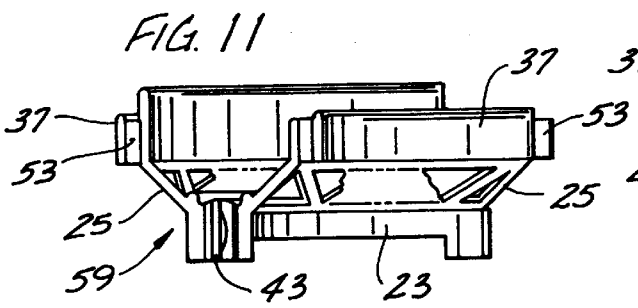
FIG. 11 is a side elevation of the FIG. 10 track.
Figure 14:
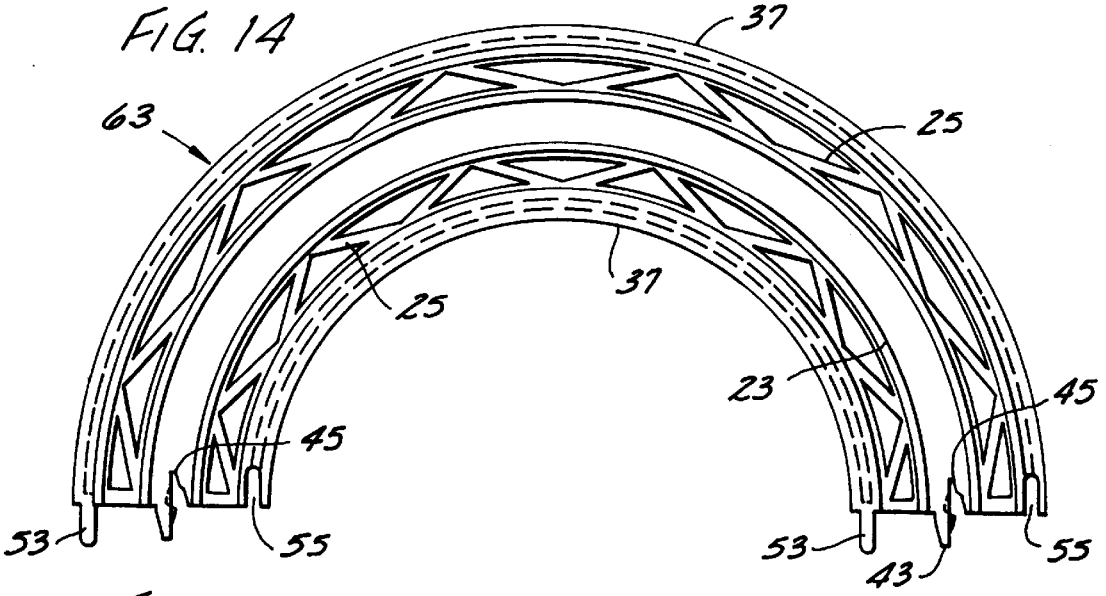
FIG. 14 is a top plan view of a 180° curved track such as used in the construction, on the scale of FIG. 4.
Figure 15:
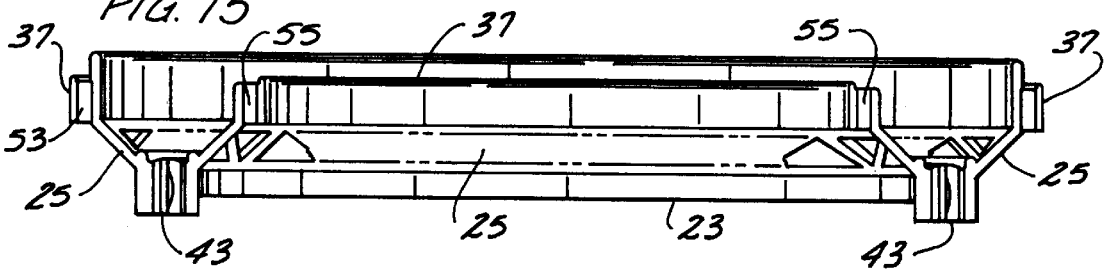
FIG. 15 is a side elevation of the FIG. 14. track.

A kit of parts for construction of the toy may comprise a number of the long tracks 21, one or more of each of a short track (not shown since it corresponds to the long track 21 only shorter), a track 59 curved through a 45° arc of a circle as shown in FIGS. 10 and 11, a track 61 curved through a 90° arc of a circle as shown in FIGS. 12 and 13, and a track 63 curved through a 180° arc of a circle (a semicircle) as shown in FIGS. 14 and 15. The short track and each of the curved tracks may be made like the long track, and the same reference numbers are used for the parts of these tracks as are used for the parts of the long track. The outside upper rails of the curved tracks are higher than the inside upper rails as appears in FIGS. 11, 13 and 15 to prevent the ball from jumping off as it rounds the curve.

Figure 16:
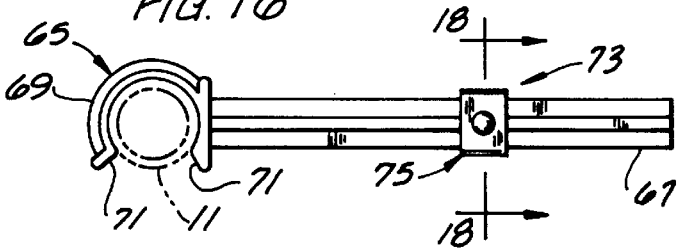
FIG. 16 is a top plan view of a bracket having a track connector slidable thereon such as used in the construction.
Figure 17:
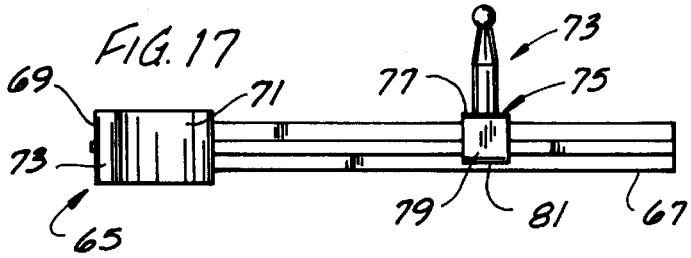
FIG. 17 is a side elevation of the FIG. 16 arrangement.
Figure 18:
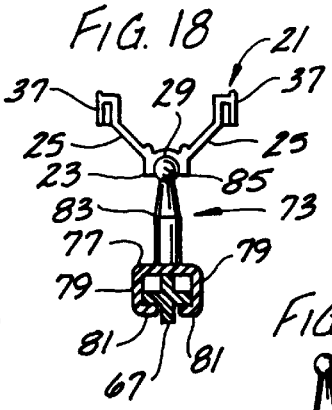
FIG. 18 is a view in cross-section on line 18—18 of FIG. 16 showing how a track such as shown in FIGS. 4–9 is mounted on the slidable connector shown in FIG. 16.
Figure 18A:
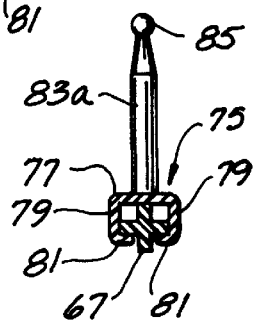
FIG. 18A is a view similar to FIG. 18 showing a modification of the slidable connector.

The aforesaid means 5 supported by selected members of the frame 1 for supporting the trackway 1 comprises a plurality of brackets each designated in entirety by the reference numeral 65 and each comprising a beam 67 shown as being of cruciform cross-section molded of plastic, preferably ABS plastic, with a generally C-shaped clip 69 at one of the beam (see FIGS. 16 and 17). This clip is so dimensioned relative to the outside diameter of each of the tubular columns 11 as to be adapted for quick assembly with a column by snap-fitting it on a column and, as so quick-assembled with a column at a selected elevation with respect to the column, to be rotatable about the column at that elevation to a selected angle with respect to the frame in a horizontal plane, and to be maintained in its selected elevated angulated position by its spring grip on the column. As shown, the clip has divergent end surfaces 71 at its open side for facilitating snapping it on to a column. A track connector 73 (see FIGS. 16–18) is slidable on the beam 67 of the bracket to a selected position along the length of the bracket for mounting a track such as any selected one of the tracks 21, the stated short track, or curved track, 59, 61, 63 on the bracket. The connector 73 comprises a slide 75 molded of plastic (e.g. ABS) generally of inverted U-shape having a top 77 slidable on the top of the vertical part of the cruciform section beam, sides 79 straddling the horizontal part of the cruciform section beam and inwardly directed lips 81 at the lower ends of the sides in slidable engagement with the lower surface of the horizontal part of the cruciform section beam. Extending up from the top of the slide 73 is a post 83 having a tapering upper end surmounted by a ball 85 adapted for snap fit in the undercut bottom groove 29 of the lower rail 23 of the track. The construction is such as to enable quick-connection of a bracket 65 to a column at a selected elevation and angle with the cruciform-section beam 67 of the bracket cantilevered out from the column, and quick connection of a track to the bracket with the track spaced a selected distance from the column and at a selected inclination. FIG. 18A shows a modification with a taller post 83*a*.

Figure 19:
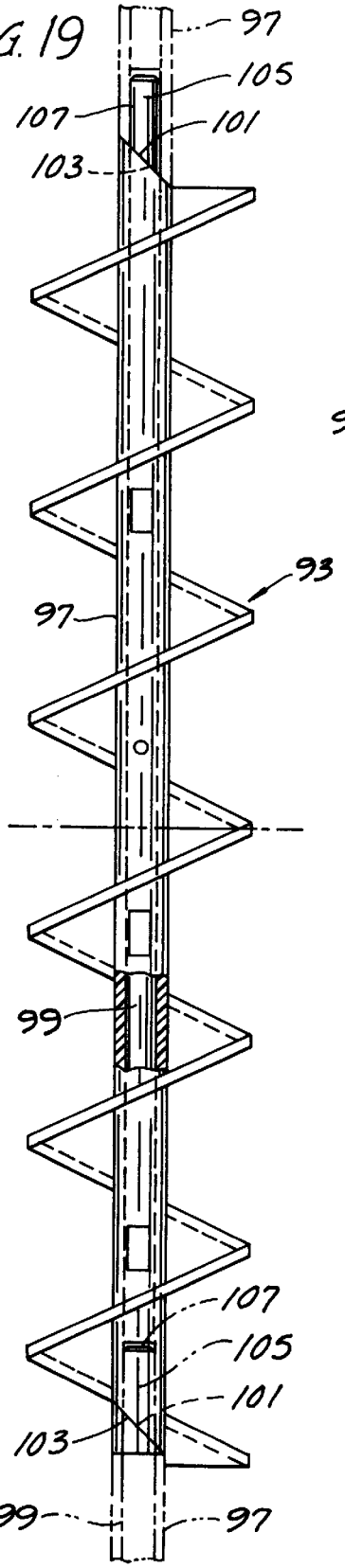
FIG. 19 is a view showing in solid lines a side elevation of a part of a multi-part screw or worm such as used in the elevator of the construction, and showing in phantom how additional parts are assembled therewith in the construction.
Figure 19A:
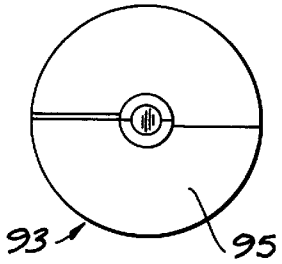
FIG. 19A is a plan view of the screw part shown in FIG. 19.
Figure 20:
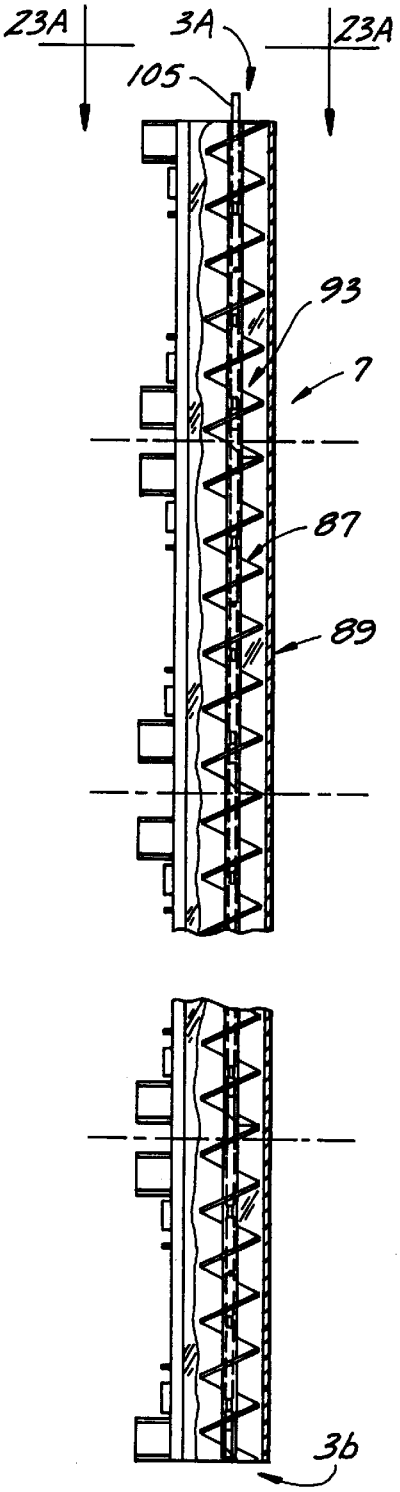
FIG. 20 is a semi-diagrammatic view showing the assembly of FIG. 19 screw parts to form the screw and the assembly of certain elevator parts with parts omitted to reduce the height of the view.

The elevator 7 is in the nature of an Archimedes screw conveyor, comprising a screw or worm designated in its entirety by the reference numeral 87 extending vertically within a housing designated in its entirety by the reference numeral 89 from the stated lower terminal position 3*b* up to the stated elevated starting position 3*a* (see particularly FIGS. 1 and 20). The screw 87 and housing 89 extend upward from a molded plastic base 91. The screw is assembled, e.g. of six individual parts, one of which, designated 93 in its entirety, is shown in FIG. 19 as comprising a helical screw flight 95 on a central tube 97. The helical flight and the central tube are molded in one piece of plastic, preferably ABS, on a metal shaft 99. The central tube has mitered ends as indicated at 101 and 103. The center shaft 49 projects upward at one end out of the center tube 97 as indicated at 105 and terminates short of the lower end of the tube to provide a socket 107 for reception of the projecting end 105 of another part 93 in line therewith as shown in phantom in FIG. 19 and as shown in FIG. 20A. Thus, as to the assembly of the six screw parts 93 to form the screw 87 as diagrammed in FIG. 20, the lowermost of the parts has its socket 107 at the lower end of the assembly and the projecting shaft end 105 of each of the parts above the lowermost part is inserted in the socket 107 of the next part above, with a driving connection established by the miters 101 and 103 at the meeting ends of the tubes 97, and with the projecting end 105 of the shaft of the uppermost part extending up at the upper end of the assembly. The flight on each screw member is so formed that when the members are assembled the flights form a continuous screw.

Figure 21:
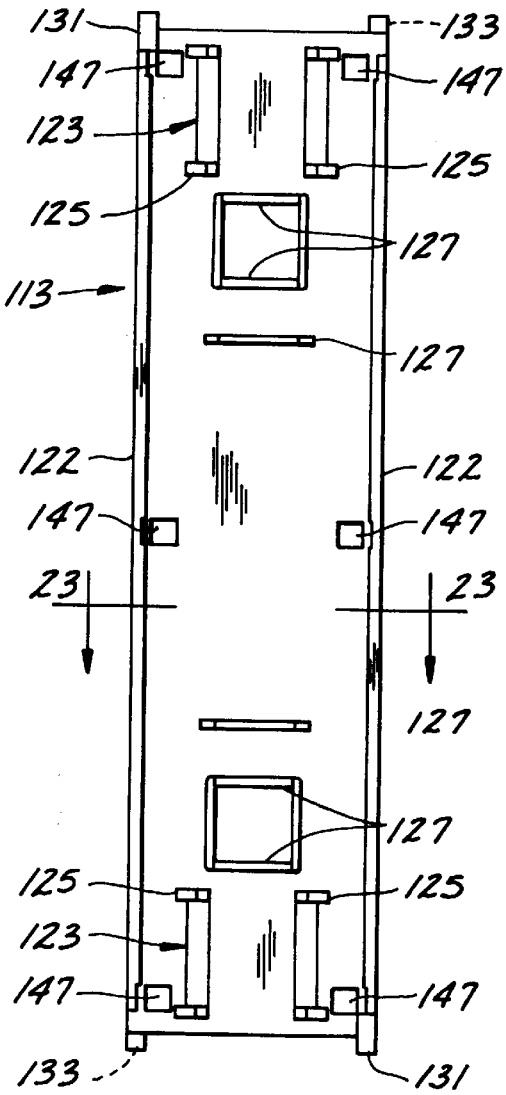
FIG. 21 is a view in elevation of the rear of a back plate part constituting one of an assembly of back plate parts for forming the back plate of the elevator in the construction.
Figure 22:
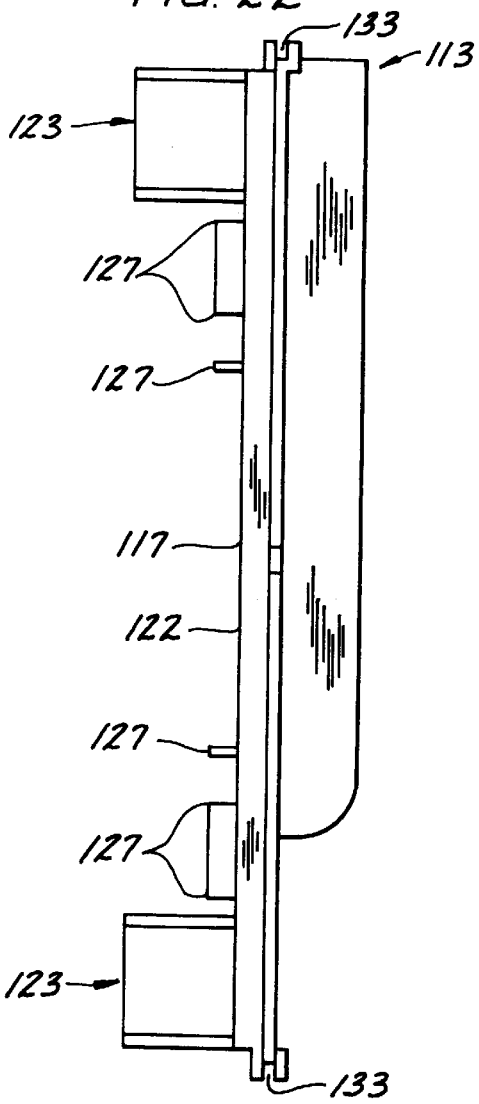
FIG. 22 is a side elevation of the back plate part shown in FIG. 21.
Figure 23:
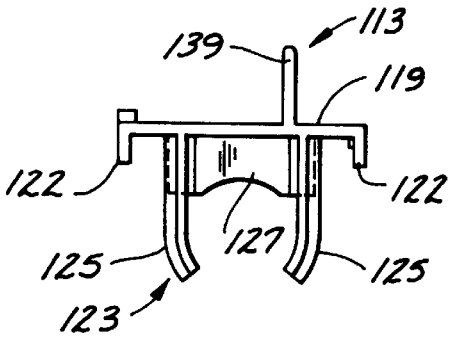
FIG. 23 is a view of the back plate part of FIGS. 21 and 22 in transverse section on line 23—23 of FIG. 21, showing how the part clips onto a column of the construction, the column being shown in phantom.
Figure 23A:
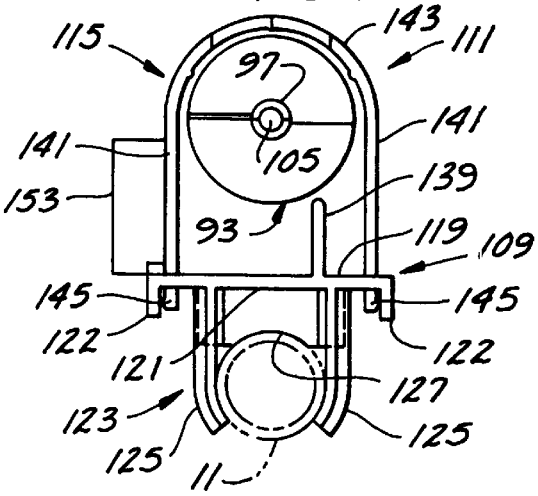
FIG. 23A is a view generally on line 23A—23A of FIG. 20, on a larger scale than FIG. 20.
Figure 24:
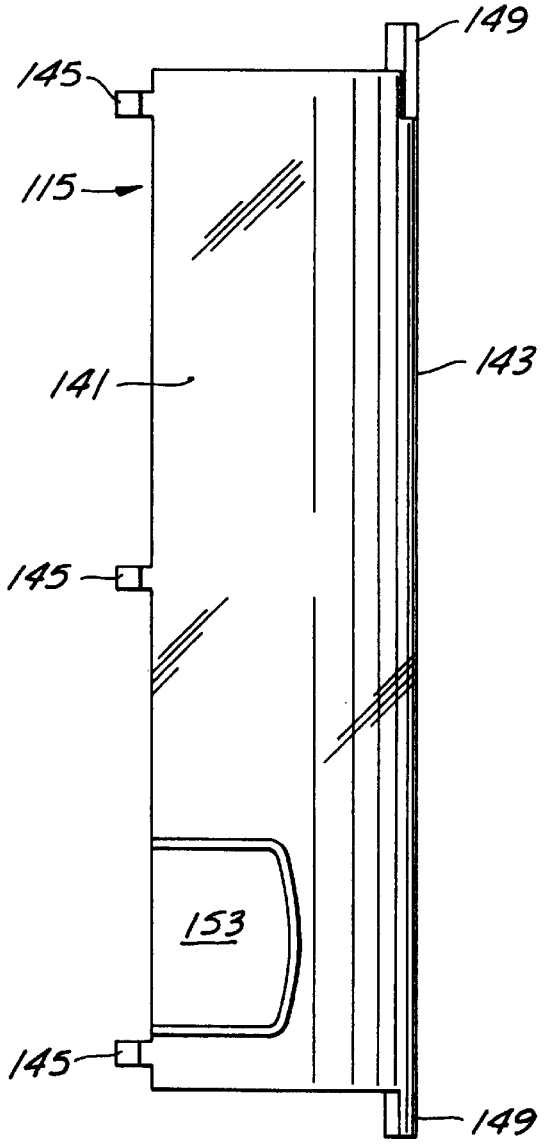
FIG. 24 is a view in side elevation of a part constituting one of an assembly of parts for forming a front cover of the elevator.
Figure 25:
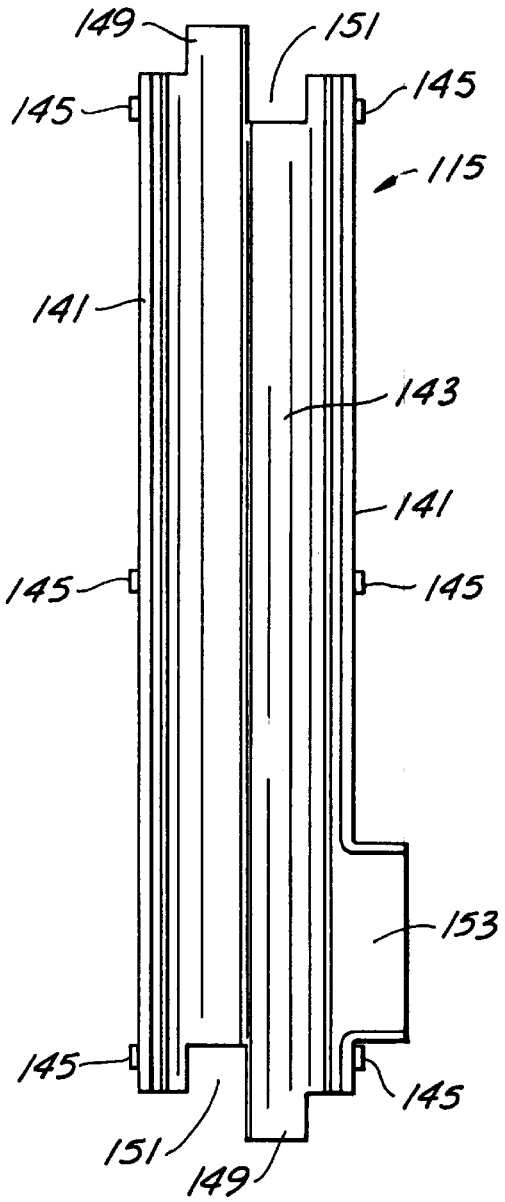
FIG. 25 is a view in elevation of the elevator cover part shown in FIGS. 24 and 25 taken on line 25—25 of FIG. 26.
Figure 26:
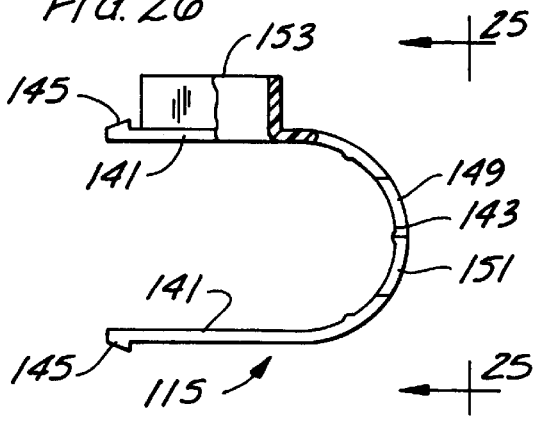
FIG. 26 is a bottom plan view of the elevator cover part shown in FIG. 24.
Figure 27:
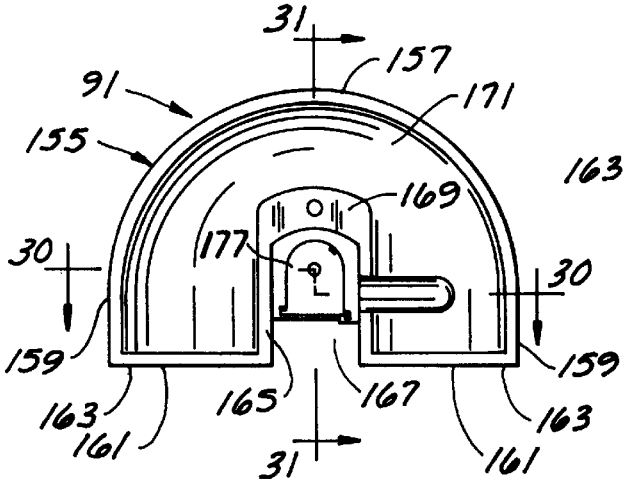
FIG. 27 is a plan view of a base for the elevator such as used in the construction.
Figure 28:
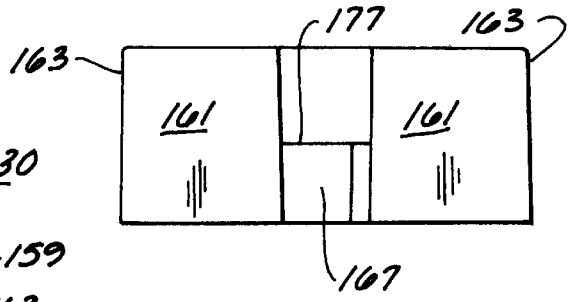
FIG. 28 is a view in rear elevation of the base taken on line 28—28 of FIG. 27.
Figure 29:
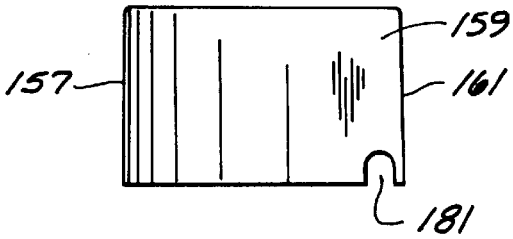
FIG. 29 is a view in side elevation of the base as viewed from the left of FIG. 28.
Figure 30:
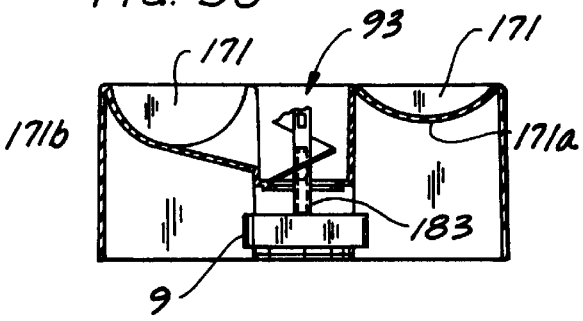
FIGS. 30 and 31 are vertical sections taken generally on lines 30—30 and 31—31 of FIG. 29, showing how the lower end of the elevator screw is assembled with the base.

The housing 89 comprises an elongate back plate designated in its entirety by the reference numeral 109 and an elongate transparent front cover 111 (see FIGS. 1, 2, 20 and 23A), each assembled from individual parts. Thus, the back plate 109 comprises an assembly of a number of elongate back plate parts, one of which, designated 113 in its entirety, is shown in FIGS. 21–23, said parts 113 being arranged vertically end-to-end on the frame 1. The front cover 111 similarly comprises an assembly of a number of elongate front cover parts, one of which, designated 115 in its entirety, is shown in FIGS. 24–26, these cover parts being arranged vertically end-to-end on the front of the back plate 109 enclosing the screw 87. Each back plate part 113 is preferably molded of plastic (e.g. ABS) comprising an elongate web 117 having a width somewhat greater than the diameter of the screw 87, the web having a front face 119 and a back face 121, and flanges 122 extending back from the back face. Each back plate is molded with means generally designated 123 adjacent its upper and lower ends for quick-connection of the plate to a column or columns 11 of the frame 1. Each quick-connection means 123 comprises a pair of arms each designated 125 extending out from the back face 121 of the plate adjacent the respective end of the plate forming a clip for clipping on a column and seats such as indicated at 127 on the back face each having a curved surface for engagement with the column when the plate is clipped on the column (see FIG. 23A). For maintaining the plates in coplanar end-to-end relation when clipped to the columns, each plate is formed with a tongue 131 and a notch 133 at one end and a tongue 135 and notch 137 at the other end, the tongue and notch at said one end being arranged in opposite relation to the tongue and notch at the other. The arrangement is such as to provide for assembly of the plate parts 113 clipped to a series of aligned columns 11 in vertical series end-to-end with the tongues of each intermediate plate part of the series engaged in the notches of the adjacent plate parts for maintaining the plate parts in said coplanar end-to-end relationship. Each plate 113 has a stiffening rib 139 extending vertically on its front face.

Each front cover part 115 (see FIGS. 24–26) is molded of a suitable transparent plastic (e.g. transparent ABS plastic) generally of U-shape in transverse (horizontal) cross section having sides each designated 141 and a semi-circularly curved front 143. The sides are molded with hook formations such as indicated at 145 at intervals along their edges for snap-hooking interengagement with the back plates in holes 147 (see FIG. 21) in the back plates. The curved front wall 143 of each cover part 115 has a tongue 149 and a notch 151 at one end and an oppositely arranged tongue 149 and notch 151 at the other end, the arrangement being such as to provide for assembly of the cover parts with each other (and with the series of back plates) with interengagement of tongues and notches for alignment purposes. Each cover part is formed with a ball inlet 153 in one of the sides 141 thereof adjacent one end constituting its lower end.

The base 91 of the elevator 7 (see FIGS. 27–31) is molded of plastic (e.g. ABS) being formed as a hollow body having a vertical peripheral wall 155 generally C-shaped in horizontal cross-section having a semicircular portion as indicated at 157 constituting what may be regarded as the front wall of the base and vertical straight (flat) sides each designated 159. At the rear the base has vertical flat walls each designated 161 extending inward in a vertical plane from the rear edges 163 of the flat sides 159 of the base. These rear walls 161 terminate short of one another. Walls 165 extend toward the front of the base from the edges of the walls 161, defining a recess 167 extending toward the front of the base from the rear. The base has a top 169 formed to provide a ball guide channel 171 which curves around for somewhat more than 180° of arc and slopes down from an upper end indicated at 171*a* at one side of the base to a lower end indicated at 171*b* at the other side of the base. Within the recess 167 the base has a stepped formation generally indicated at 175 including a horizontal wall 177 having an opening 179 therein. Within the base is the electric motor 9, e.g. a gear motor, having an output shaft 181 extending up through the opening 179. On this shaft is a coupling 183 for establishing a driving connection with the lower end of the lower elevator screw part. The motor ouput shaft 181 extends up out of the coupling, fitting in the socket 107 at the lower end of the lower screw part. The coupling has a mitered upper end formation 184 complementary to the miter at the lower end of the screw for establishing a driving connection. Suitable provision is made for turning the motor on and off, it being understood that the motor is maintained in operation for as long as the toy is to be operated. The walls 159 of the base are formed with notches 185 extending up from their lower edges closely adjacent the rear edges 163 of the walls 159 for assembly of the base with a beam 13 at the bottom of the frame as illustrated in FIG. 1. In assembling the toy, the lower end of the elevator (the lower end of the lowermost back plate, the lowermost front cover part and the lowermost screw part) are received in the recess 167. The lower end of the lowermost back part plate 113, and the lower end of the lowermost front cover part 115 bear on the horizontal wall 177, the screw shaft being socketed in the socket 183 on motor output shaft as above described. In this assembly, the ball inlet 153 of the lowermost cover part 115 is registered with a ball passage 185 in the base at the low end of the channel 169 at the top of the base, the arrangement being such that a ball dropping into the channel will roll around and down in the channel and pass through the passage 185 and the ball inlet 153 to the position where it is engaged by the screw for being raised by the screw to the top of the elevator.

Figure 34:
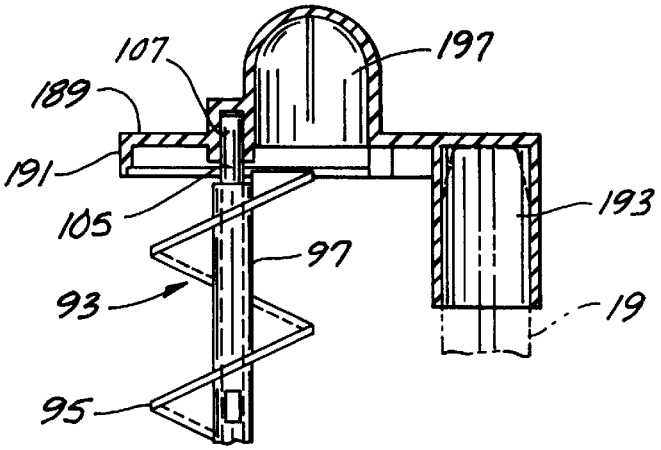

At its upper end, more particularly at the upper end of its upper part, the screw 87 is journalled for rotation on a vertical axis in an elevator top member which may be referred to as the elevator head, designated in its entirety by the reference character 187 (see FIGS. 32–35). This top member or head 187 is molded of plastic, (e.g. ABS). It is formed with what may be referred to as a cap 189 for the upper end of the elevator back plate assembly and front cover assembly, the cap having a skirt 191 around part of its periphery which extends down on the outside of the upper end of the upper front cover part. The cap is formed with a downwardly opening socket 193 at one side thereof, which is its rear side, for receiving with a friction fit the projection 19 of the connector 15 at the upper end of the uppermost column 11 on which the elevator 7 (more particularly the upper elevator back plate 113) is mounted. Thus, the cap extends forward from that column at the upper end thereof, and as appears in FIG. 34 is formed with a downwardly opening recess 195 in which the upper end of the screw 87, more particularly the projecting end 105 of the screw shaft 99 at the upper end of the screw, is journalled for rotation on the vertical axis of the screw. It will be apparent that the elevator head is so mounted on the frame that the recess 195 is coaxial with the output shaft of the motor 9. Adjacent the recess, the cap 189 is formed with a ball exit 197 for delivery by the screw of the ball from the upper end of the screw to a delivery chute 199 at one side of the head 187 at position 3*a*, the ball rolling down this chute and dropping off its outer end onto the first of the tracks of the trackway at the upper end of the trackway.

Figure 36:
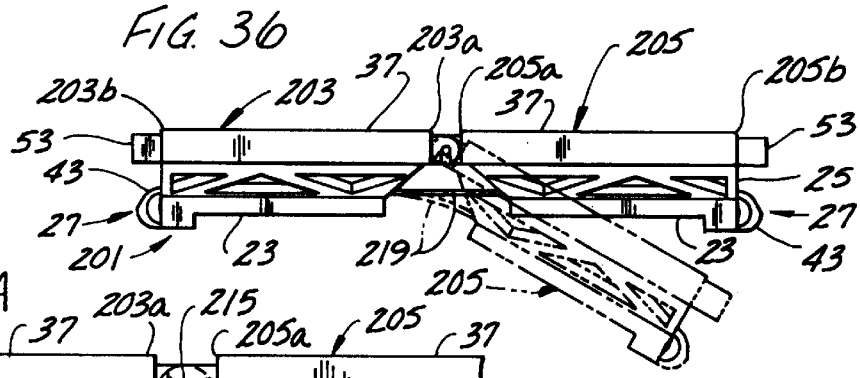
FIG. 36 is a view in side elevation of an articulated trackway member (for constructing the trackway with a change in slope), showing in phantom an angled position of two components of the member.
Figure 36A:
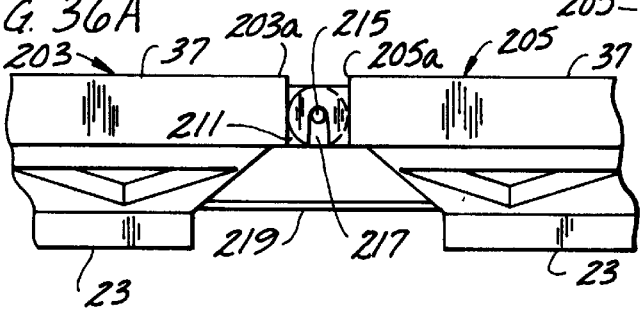
FIG. 36A is an enlarged fragment of FIG. 36.
Figure 38:
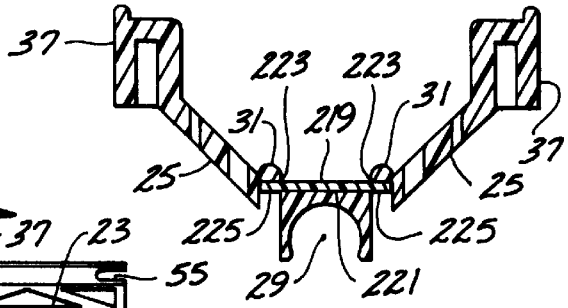
FIG. 38 is a transverse section of the FIG. 30 part taken generally on line 38—38 of FIG. 37.
Figure 37:
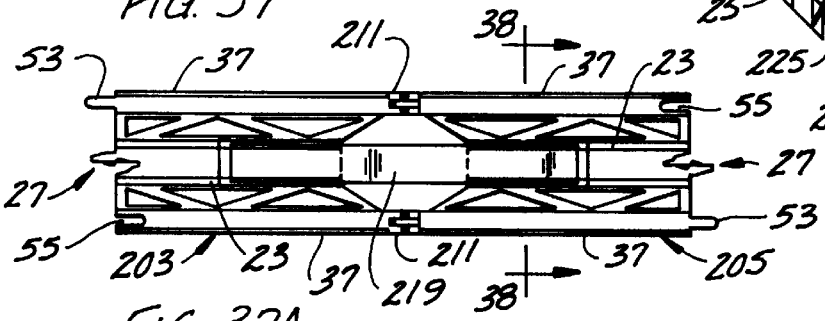
FIG. 37 is a top plan of the FIG. 36 member.
Figure 37A:
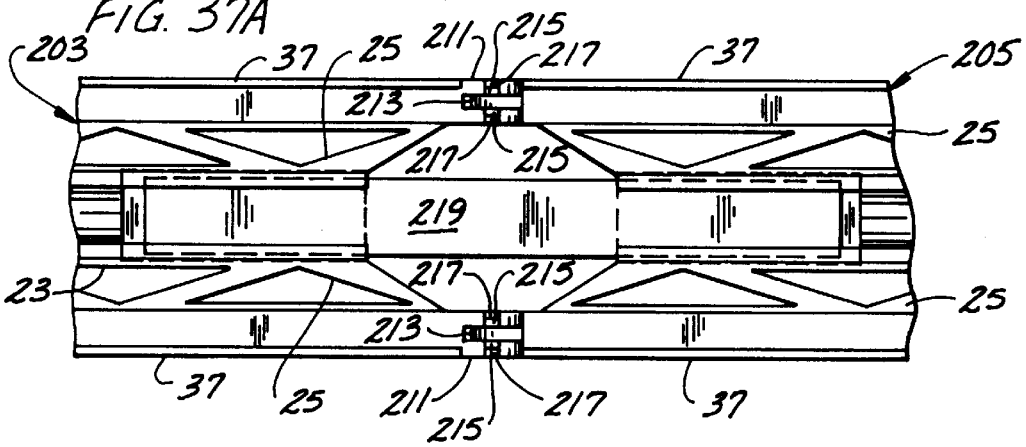
FIG. 37A is an enlarged frament of FIG. 37.

As shown in FIGS. 1 and 2, the assembly may include one or more trackway parts indicated at 201 for constructing the assembly with a change in the slope of the trackway, one of these parts being illustrated per se in FIGS. 36–38, and being constituted by an articulated track member comprising a first track 203 and a second track 205 each corresponding generally to the track 21 in comprising an elongate molded plastic (e.g. ABS) member generally of V-shape in cross-section having a bottom rail again designated 23, sides again designated 25 and upper rails again designated 37. Each of the tracks 203 and 205 is illustrated as having a first end indicated at 203*a*, 205*a* and a second end 203*b*, 205*b*. The upper rails 37 of each track project beyond the transverse planes of the ends of the bottom rail 23 at the first end of the track, the sides 25 of each of the tracks being mitered at the track ends 203*a* and 205*a* as indicated at 209, extending in angulated relation from the projecting end of the upper rail 37 to the end of the bottom rail 23. The two tracks are pivotally interconnected end-to-end at the projecting ends of the upper rails 37 for swinging movement about an axis extending transversely with respect to the tracks, this pivotal interconnection being effected by forming the first track 203 at the projecting end 207 of each upper rail 37 thereof at the stated first end of track 203 as a clevis 211, forming the track 205 at the projecting end of each upper rail 37 thereof at the stated first end of 205*a* of track 205 with a tongue 213 and pivot pins 215 extending laterally outwardly on both sides of each tongue, each clevis being spread apart for entering the pins 215 in recesses 217 in the sides thereof. At 219 is indicated a flexible member, more particularly a flexible plastic (e.g. Nylon) strap, extending between the lower rails of the two tracks 203 and 205 at the stated first ends 203*a*, 205*a* thereof. The bottom rail of each track 203, 205 is formed with a flat upper surface 221 at the stated first end of each track and the rail heads 31 of the bottom rail of each track are slotted as indicated at 223 at opposite sides of each of the flat surfaces. The strap is formed with laterally extending ears 225 at its ends, these ears being slidable in the slots 223. Means 27 at the second end of each track 203 and 205 provides for quick interconnection therewith of another track of the trackway. The bottom rail 23 of each track 203, 205 is formed with the groove 29 for quick interconnection thereof to the post 83 on a bracket 65. The construction of the articulated trackway part 201 is such that one of the tracks 203, 205 may be angled with respect to the other (as shown in phantom in FIG. 36) for providing a change in the slope of the trackway at a selected point (namely, at the meeting ends of the angled tracks 203, 205), the flexible strap 219 bending and sliding relative to the tracks in accordance with the angling of the parts and bridging the space between the adjacent (but spaced) first ends of the lower rails 23 of the two tracks and thus forming a bridge for rolling of the ball thereon from the lower rail 23 of the one track to the lower rail 23 of the other.

Figure 39:
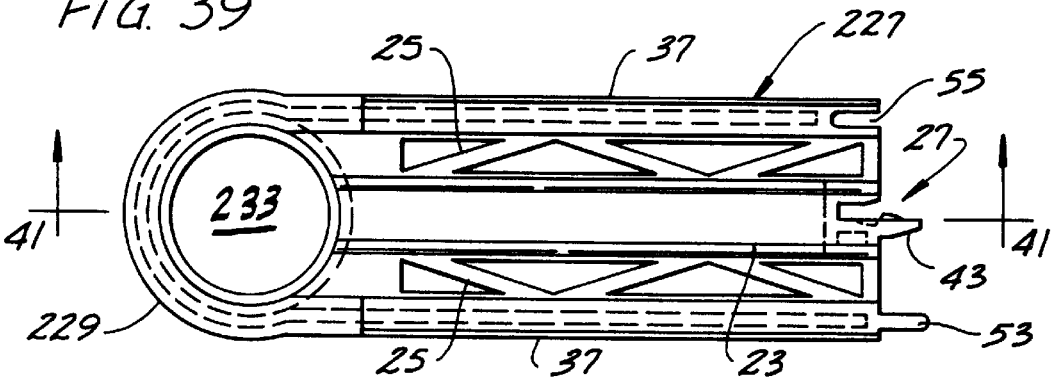
FIG. 39 is a top plan of a trackway part comprising a track with what may be referred to as a ball drop end.
Figure 40:
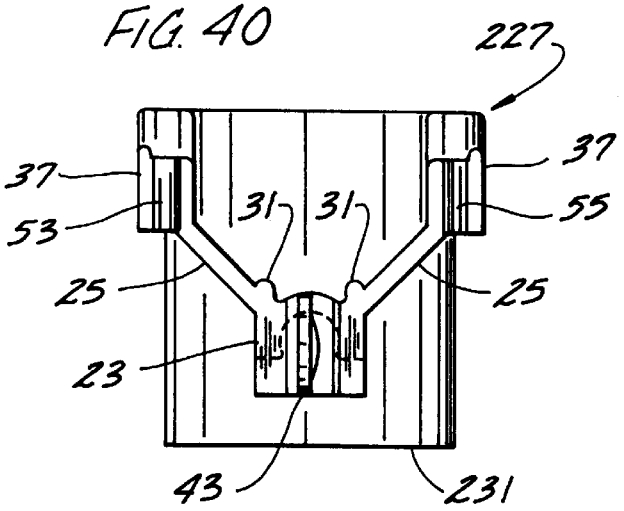
FIG. 40 is an end view of FIG. 39 as viewed from the right end of FIG. 39.
Figure 41:
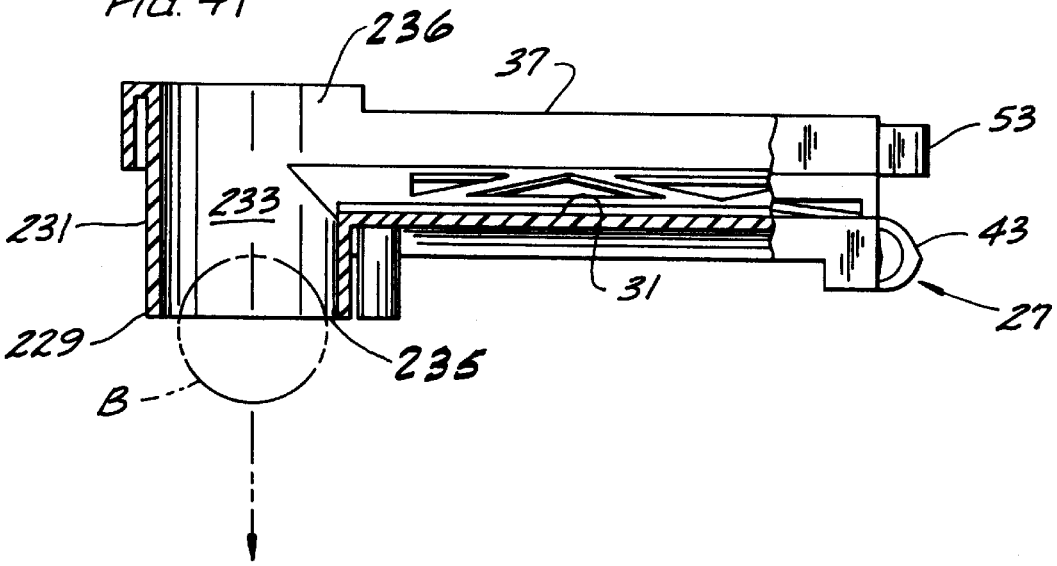
FIG. 41 is a longitudinal section of the FIG. 39 part taken on line 41—41 of FIG. 39.

Referring to FIGS. 39–41, there is shown a trackway part adapted for use in the trackway at a point where the ball is to drop off, this part comprising a track 227 with what may be referred to as a ball-drop end at 229 constituting a free end. The track 227 is shown as corresponding generally to the track 21 in comprising an elongate molded plastic (e.g. ABS) member generally of V-shape in cross-section having a bottom rail again designated 23, sides again designated 25 and upper rails again designated 37. At its ball-drop or free end 229, the track has a head 231 having a downwardly directed ball passage 233 therein having an open lower end 235. At its other end, the track 227 has means 27 providing for quick interconnection thereof to another track of the trackway with the track 227 inclined downward toward its ball-drop end for rolling of the ball down the track to its ball-drop end, where the ball is directed through said passage to drop straight down.

The head 231 is of generally tubular form extending transversely (up and down) with respect to said track and extending down from said track. The head being tubular, has said downwardly directed passage 233 therein. The head has opening 236 for entry of a ball rolling down the track. The ball passage 233 is open at its lower end, a ball rolling down the track entering the head via said entry opening and dropping down through the ball passage and out of the lower end of said passage.

As illustrated herein, the trackway 3 is constructed with diverse routes for the ball B and includes ball-operated means for switching from one route to another on alternate descents of the ball. Two types of such ball-operated switch means or switches are disclosed, the first shown in FIGS. 42 and 43 designated in its entirety by the reference numeral 237 being operable by a ball dropping down (as from the ball-drop end of the aforesaid track 227), and the second shown in FIGS. 44 and 45 and designated in its entirety by the reference numeral 238 being operable by a rolling ball, each switch being operable to switch the ball from one route to another on alternate descents of the ball.

The ball-drop-operated switch 237 (FIGS. 42 and 43) comprises a track member 239 corresponding generally to the track 21 in comprising an elongate molded plastic (e.g. ABS) member generally of V-shape in cross-section having the aforesaid bottom rail 23 (with the downwardly opening groove 29), divergent sides 25 and upper rails 37, with quick connection means 27 at its ends. The track member 239 forms a bottom for the switch, and has sides 241 extending up generally vertically therefrom. Each of these sides is molded of plastic (e.g. ABS), being shown as in the configuration of a Warren truss with a lower chord 243, a bowed upper chord 245, and inclined web members including two members each designated 247 forming a V midway of the length of the truss, each truss being molded with a tubular bearing 249 at the bottom of the V. The lower chord 243 of each truss is formed at each end on the inside thereof with an inwardly opening C-formation forming a clip 251 applied to a respective upper rail 37 as shown and slidable on the upper rail for establishing a location for the truss (and the bearing 249) centered along the length of the track.

A switch member designated in its entirety by the reference numeral 253, molded of plastic (e.g. ABS), is pivoted for swinging movement on a generally horizontal axis, namely the axis of bearings 249, in a generally vertical plane between the vertical sides 241 (the trusses) above the bottom (track 239) of the switch 237. This switch member 253 comprises an elongate flat lever 255 having a transverse hub 257 midway of its length with pivot pins 259 extending from the ends of the hub journalled in the bearings 249 for swinging movement of member 253 on the axis of the bearings. Lever 255 may be thought of as corresponding to the plank of a seesaw That part **255*a* of the lever extending in one direction from its said axis is referred to as a first ramp and that part 255*b* of the lever extending in the opposite direction from its said axis may be referred to as a second ramp. Thus, the lever in its entirety may be referred to as a ramp-forming member. It has a flat arm or vane 261 extending up from the hub 257** generally at right angles to the lever in a plane including the axis of the lever.

Figure 42:
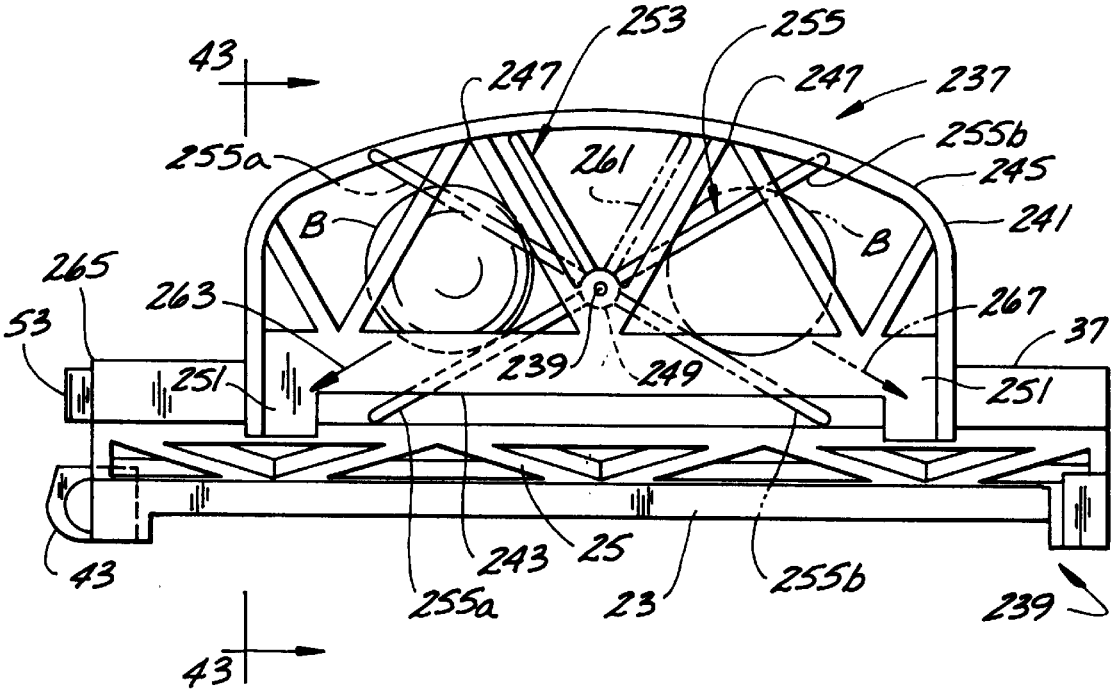
FIG. 42 is a view in side elevation of a trackway part for switching the ball from one route to another.
Figure 43:
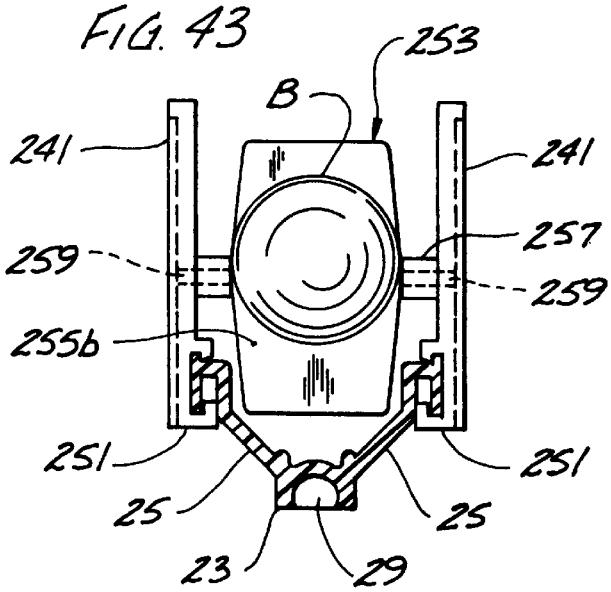
FIG. 43 is a view in section on line 43—43 of FIG. 42.

The switch member 253 is swingable on its axis between a first position shown in solid lines in FIG. 42 wherein the free end of the first ramp **255*a* is down toward the track 239 (the bottom of the switch 237) and wherein the first ramp slants down in the direction of arrow 263 in FIG. 42 toward the adjacent end 265 of the track (its left end as viewed in FIG. 42), and a second position such as shown in phantom in FIG. 42 wherein the free end of the second ramp 255*b* is down toward the track 239 and the second ramp slants down in the direction of arrow 267 toward the other end 269 of the track. The arrangement is such that a ball dropping down between the vane 261 and the first ramp 255*a* when the switch member is in the stated second position (the phantom position shown in FIG. 42) acts to swing member 253 to the stated first position (the solid-line position shown in FIG. 42), resulting in the ball rolling down the first ramp 255*a* in the direction of the arrow 263, and a ball dropping down between the vane and the second ramp 255*b* when the switch member is in the stated first position (the position shown in solid lines in FIG. 42) acts to swing member 253 from the first position to the stated second position (the position shown in phantom in FIG. 42), resulting in the ball rolling down the second ramp in the direction of the arrow 267**.

The rolling-ball operated switch 238 (FIGS. 44 and 45) comprises a track member molded of plastic (e.g. ABS) in a generally Y-shaped configuration as viewed in plan having an upstream lane 271 and two downstream lanes 273 and 275 branching off from the upstream The switch 238 as used in the trackway 3 is mounted in an inclined position sloping down from the entrance end of the single lane 271 to the exit ends of the upstream lanes so that the ball rolls first down the single lane and then rolls down whichever upstream lane it is switched to, the terms "upstream" and "downstream" being used in reference to the direction of rolling of the ball. Each lane is constituted by a track formed similarly to the aforesaid track 21, being generally of V-shape in cross-section having the aforesaid bottom rail 23, (with the downwardly opening groove 29), divergent sides 25 and upper rails 37, and having quick-connection means 27 at the upstream end of the upstream lane 271 and quick-connection means 27 at the downstream end of each downstream lane 273, 275. At 277 is indicated a ball-actuated lever or gate for switching a ball which comes rolling down the upstream lane 271 from one downstream lane to the other on alternate descents of the ball. Lever 277 is pivoted for swinging movement in the plane of the switch (indicated at P in FIG. 45) on an axis generally at right angles to said plane, this axis being indicated at 279 in FIG. 44. The lever, as viewed in plan in FIG. 44, has a formation 281 in the shape of a segment of a circle having flat sides 283 and 285 which diverge away from an apex 287 (the center of the circle) and an arcuate end edge 289 extending between the outer ends of the sides. Extending from the junction of the sides in the central radial plane 291 of the segment 281 from the apex of the segment 281 is a vane 293. The segment 281 has a web 295 at the top and side flanges extending down from the web forming the sides 283 and 285. The pivot axis 279 of the lever is located in the stated central radial plane 291, the lever being pivoted for swinging movement about said axis between the first position in which it is illustrated in solid lines in FIG. 44 and the second position in which it is illustrated in phantom in FIG. 44 by means of a pivot pin 297 molded integrally with the switch 239 extending up from a widened portion 299 of the bottom rail construction of the switch into a downwardly opening hub 301 for the lever which extends down from the web 295 in the radial plane 291 adjacent the apex 289 of the segment 281. The pin 297 is located in the central plane 303 of the upstream lane 271 adjacent the upstream ends of downstream lanes 273 and 275. The lever is pivotally mounted on the pin 297 with the vane 293 extending in upstream direction, its stated first and second positions being determined by engagement of a finger 305 extending down from the web 295 with the ends of an arcuate slot 307 in the widened bottom rail portion of the switch.

Figure 44:
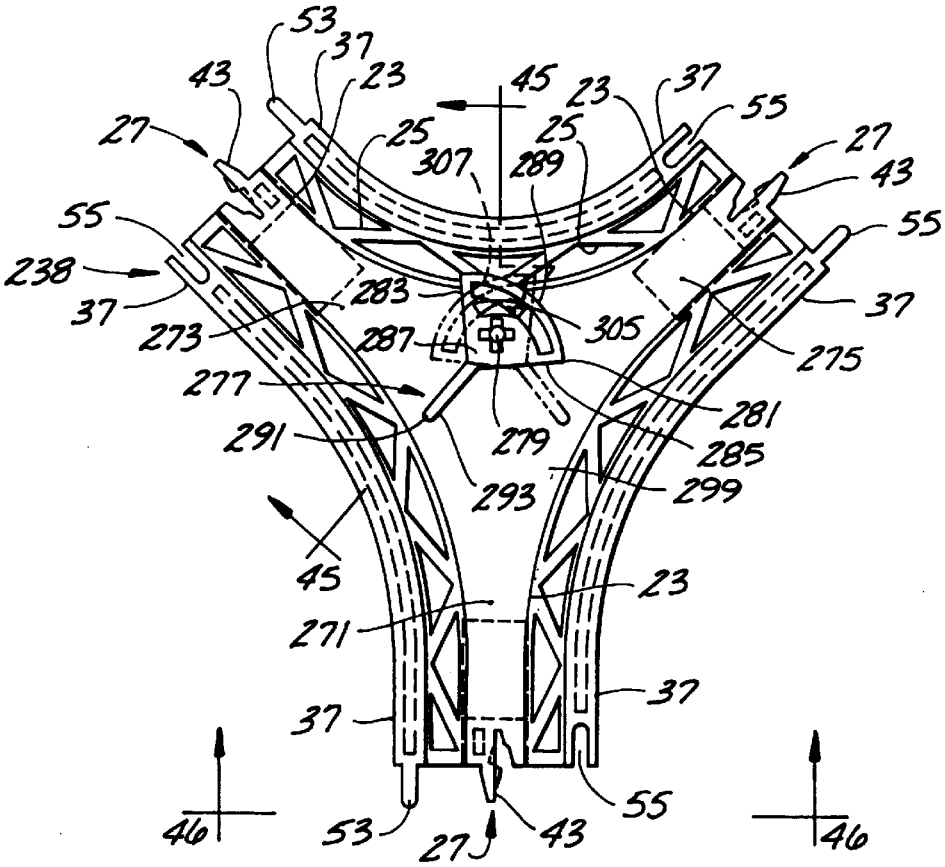
FIG. 44 is a plan of another trackway part for switching the ball from one route to another.
Figure 45:
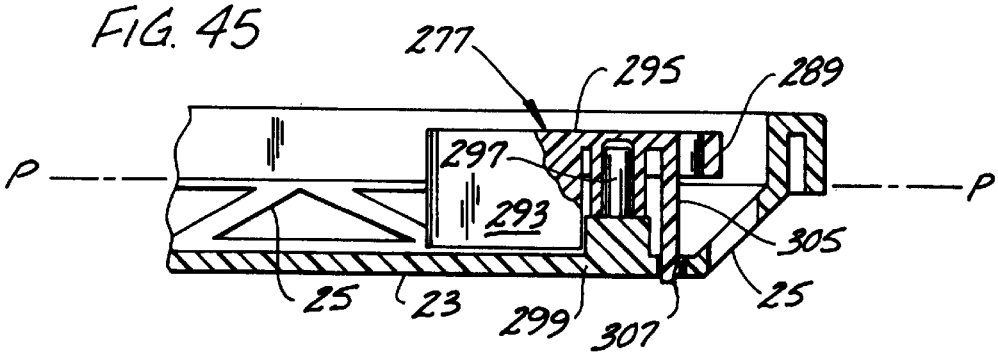
FIG. 45 is a view in section on line 45—45 of FIG. 44, on a larger scale than FIG. 44.
Figure 46:
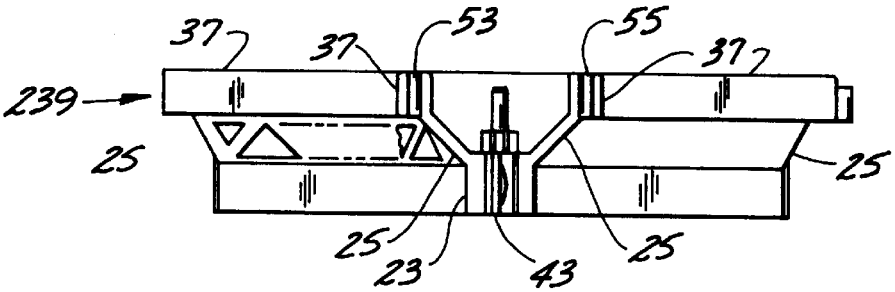
FIG. 46 is an end view of FIG. 44 as viewed on line 46—46 of FIG. 44.
Figure 47:
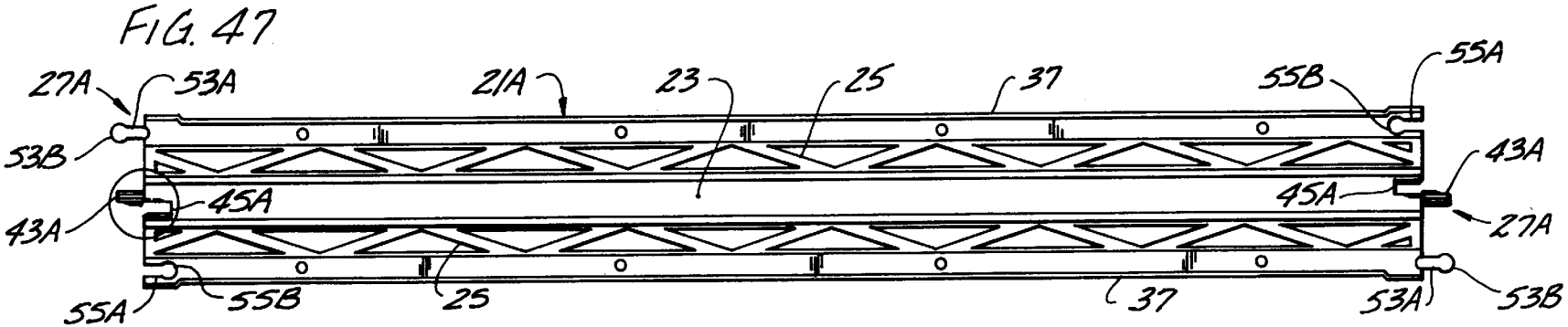
FIG. 47 is a view similar to FIG. 4 showing a modification of the quick-connection means at the ends of the track.
Figure 48:
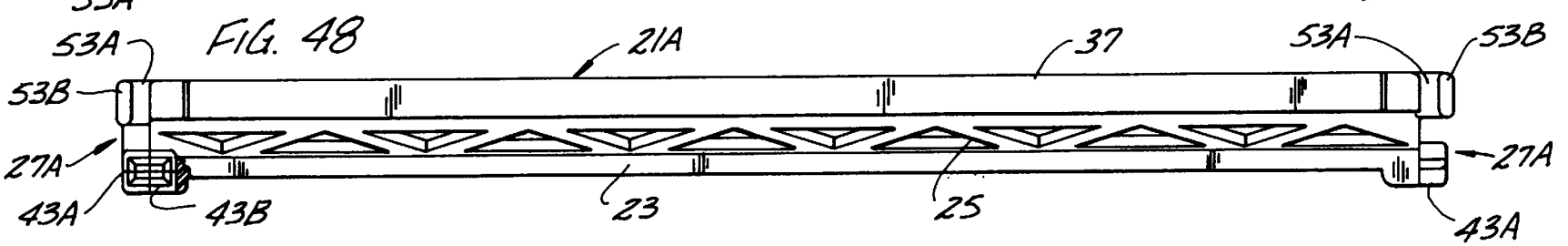
FIG. 48 is a view similar to FIG. 5 showing the FIG. 47 modification.
Figure 50:
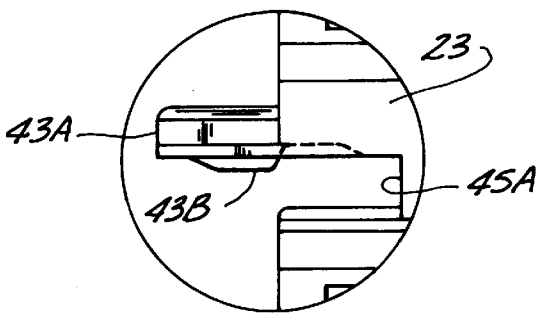
FIG. 50 is an enlarged fragment of FIG. 47.
Figure 49:
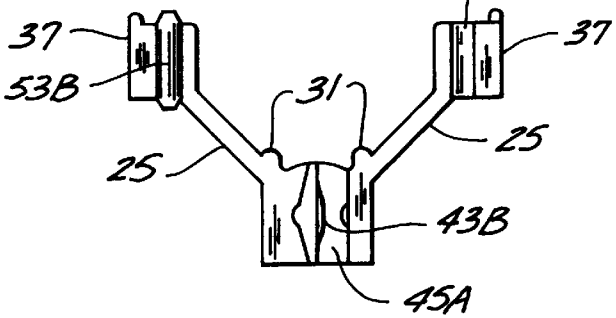
FIG. 49 is an enlarged end view of the modification shown in FIGS. 47 and 48, particularly the left end thereof.

As appears in FIG. 44, when the lever is in the stated first position, shown in solid lines in FIG. 44, the vane 293 is positioned to deflect a ball rolling down in lane 271 in the direction toward lane 275. Side 285 of the formation 281 of the lever is positioned for engagement by the ball as it rolls down toward lane 275 to swing the lever to its second position shown in phantom in FIG. 44 the ball thereby traveling on down in lane 275. In said second (phantom) position of the lever, vane 293 is positioned to deflect a ball rolling down in lane 271 in the direction toward lane 273, and side 283 of the formation 281 of the lever is positioned for engagement by the ball as it rolls down toward lane 273 to swing the lever to the first (solid line) position, the ball thereby traveling on down in lane 273. Thus, on the successive descents of the ball, it is directed to lane 273, then directed to lane 275, then to lane 273, etc.

Following the preceding description of the component parts for constructing a toy according to the invention, and reverting to FIGS. 1 and 2, it will be observed that the construction shown therein is configured with the trackway 3 having a first section S1 constituting its uppermost section extending down from the top or head 187 of the elevator 7 comprising a track 21 supported in inclined position extending down from the chute 199 of the elevator head 187, an articulated track member 201, a 180° curved track 63, another articulated track member 201, another track 21 and a ball-drop track 227. These parts are connected together in the order stated by the quick-connection means 27 thereof The ball-drop track 227 is positioned with its head 231 having the ball-drop passage 233 therein directly above the midpoint of a ball-drop-operated switch 237.

The switch 237 directs the ball dropping down out of the passage either to a trackway section S2 or a trackway section S3 of the trackway. The trackway section S2 is constructed of articulated track members and straight and curved track members extending down to the upstream lane 271 of a rolling-ball-operated switch 238. The latter switch directs the ball rolling down trackway section S2 either to a section S4 or a section S5 of the trackway. Trackway section S4 extends down to the elevator base 91. Trackway section S5 extends to the upstream lane 271 of a rolling-ball-operated switch 238 which directs a ball rolling down trackway section S5 to a trackway section S6 or a trackway section S7, each of which extends down to the elevator base 91. Trackway section S3 extends down to ball-drop track 227 which drops the ball into trackway S2 just upstream from the switch 238 to which section S2 is connected. As above described, trackway section S1 is comprised of straight and curved tracks, articulated track members and a ball-drop track, and it will be understood that trackway sections S2–S7 are formed of such parts so assembled as to form the trackway section configurations illustrated in FIGS. 1 and 2.

The motor 9 is maintained in continuous operation for continuous operation of the toy automatically to recycle the ball for operation in cycles, one after another, in each of which the ball is raised by the elevator 7 from the base 91 of the elevator to the head 187 of the elevator, the ball being visible through the transparent front cover of the elevator throughout its ascent. A cycle may be regarded as starting when the ball has reached the head of the elevator and is delivered to the starting end (the upper end) of the trackway 3. The ball rolls down section S1 of the trackway, drops off the downstream end of this section through the passage 233 of the track 227 at the downstream end of section S1 and down to the ball-drop-operated switch 237 therebelow. Assuming the switch member 253 of the switch 237 is in its phantom-line position of FIG. 42, the ball is directed to trackway section S2, and rolls down the latter to the switch 238 at the downstream end of section S2. Assuming this switch 238 is in the position for travel of the ball down its lane 273, the ball then proceeds down section S5 to the switch 238 at the downstream end of section S5. Assuming that switch 238 is in the position for travel of the ball down its lane 273, the ball proceeds down section S6 to the base 91 of the elevator. Here it travels in the channel 171 and enters the elevator at the lower end of the elevator through the ball inlet at the lower end of the elevator The elevator screw, rotating in the direction to move the ball up in the elevator housing, raises the ball up to the elevator head to start the next cycle.

On said next cycle, the ball rolls down section S1, drops down into the switch 237 below the downstream end of section S1, and is directed by the switch to trackway section S3. The ball rolls down section S3 to the ball-drop track 227 at the downstream end of this section, and drops down into trackway section S2 just upstream from switch 238 at the downstream end of section S2. This switch is now in the position for travel of the ball down its lane 275, and thus the ball rolls down trackway section S4 to the elevator base 91, and is raised back to the elevator head to start its next cycle. On the next cycle, the ball drops off the downstream end of trackway section S1 down to the switch 237 therebelow, and this time is directed by that switch to trackway section S2, further progression of the ball on said next cycle and on succeeding cycles being believed apparent, generally involving change in routing of the ball on successive cycles.

FIGS. 47–50 show a track 21A which corresponds to the track 21 shown in FIGS. 4–9 with a modification indicated at 27A of the quick-connect means 27 at the ends thereof involving formation of projections 43A (corresponding to projections 43) with a tapered rectangular boss 43B and formation of recesses 45A (corresponding to recesses 45) with a shape complementary to shape of the projections, and formation of tongues 53A (corresponding to tongues 53) with enlarged rounded ends 53B and formation of recesses 55A (corresponding to recesses 55) with enlarged rounded inner ends 55B for snap-fit of the tongues in the recesses 55A.

With the component parts of the toy made as herein disclosed, a kit of parts may be supplied in a package of a size convenient to handle. The package may include parts in addition to those herein disclosed for adding variety and also may include software for programming a computer with instructions for assembling the parts to build the toy with various configurations for the frame, various configurations for the trackway, and various locations for the elevator. Also, it is to be specially noted that, once erected, the toy may be readily disassembled and rebuilt in another configuration, the frame parts and the connectors therefor being readily taken apart, the trackway parts being readily snapped apart and readily snapped off the posts on the track-supporting brackets, the brackets being readily snapped off the columns, and the elevators parts being readily disassembled.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A track for quick assembly end-to-end with other tracks to construct a trackway for a toy of the rolling-ball type in which a ball rolls down the trackway from an elevated position at an upper level to a terminal position at a lower level, the ball being automatically returned from said terminal position to said elevated position, said track comprising an elongate molded plastic member generally of V-shape in transverse cross section having a rail extending the length thereof at the bottom for rolling of a ball thereon and sides extending up from said bottom rail diverging in upward direction, means at each end of said elongate member for quick connection thereto end-to-end of another track of similar construction, said means comprising integral projections at each end of the elongate member with recesses at each end of the elongate member receptive of the integral projections, at least certain of the integral projections recesses being formed for a snap fit, and said bottom rail being formed for quick connection of the track to a support therefor.

2. A track as set forth in claim 1 which is straight throughout its length.

3. A track as set forth in claim 1 which is curved through a 45° arc of a circle from one end to the other.

4. A track as set forth in claim 1 which is curved through a 180° arc of a circle from one end to the other.

5. A track as set forth in claim 1 having upper rails extending the length thereof at the upper edges of the sides thereof, said quick connection means comprising snap-fit means at the ends of said lower rail and friction fit means at the ends of the upper rails.

6. A track as set forth in claim 5 wherein the snap-fit means comprises a projection extending out endwise from each end of the bottom rail and a recess in each end of the bottom rail for receiving a projection on the end of the bottom rail of a track of similar construction, each projection tapering outwardly away from the respective end of the lower rail and overlapping the recess thereby forming a shoulder at the outer end of the recess engageable by the shoulder of a projection inserted in the recess detachably to hold the tracks together, the projection at one end being at one side of the recess and the projection at the other end being at the other side of the recess, the friction fit means comprising a tongue extending endwise from one end of one of the upper rails and a tongue-receiving recess in the other end of said one upper rail, and a tongue extending endwise from said other upper rail at the other end of the track and a tongue-receiving recess in said one end of said one upper rail.

7. A track as set forth in claim 1 wherein the bottom rail has a downwardly opening undercut groove extending lengthwise thereof from adjacent one end thereof to adjacent the other end thereof for snap-fit therein at a selected location along the length of the track of a snap-fit connector for supporting the track.

8. A track as set forth in claim 1 having an upstream lane and two downstream lanes branching off from the upstream lane, and a ball-actuated lever for switching a ball rolling down the upstream lane from one downstream lane to the other on alternate descents of the ball.

9. The track as set forth in claim 1 further comprising an elevator for use with the track, said elevator comprising a base and a head, a screw comprising an assembly of screw parts arranged vertically end-to-end extending up from the base to the head, a housing for the screw comprising a back plate and a cover, the back plate comprising an assembly of back plate parts arranged vertically end-to-end, and the cover comprising an assembly of cover parts arranged vertically end-to-end attached to the back plate parts, the cover having a ball inlet at the base, the head having a ball exit, and a motor in the base for driving the screw to raise the ball from said terminal position to said elevated position.

10. The track as set forth in claim 1 further comprising a switch for use with the track, said switch comprising ball-operated means for switching the ball from one route to another on alternate descents of the ball.

11. An elevator for the ball of a toy of the rolling-ball type in which a ball rolls down a trackway from an elevated position at an upper level to a terminal position at a lower level, said elevator comprising a base and a head, a screw comprising an assembly of screw parts arranged vertically end-to-end extending up from the base to the head, a housing for the screw comprising a back plate and a cover, the back plate comprising an assembly of back plate parts arranged vertically end-to-end, means for maintaining said back plate parts in coplanar end-to-end relation, and the cover comprising an assembly of cover parts arranged vertically end-to-end attached to the back plate parts, each cover part being generally of U-shape in transverse cross-section and formed with means for attachment to a respective back plate part, the cover having a ball inlet at the base, the head having a ball exit, and a motor in the base for driving the screw to raise the ball from said terminal position to said elevated position.

12. An elevator as set forth in claim 11 wherein each screw part comprises a helical flight on a central tube molded of plastic on a center shaft, the shaft projecting from the tube at one end of the screw part and terminating short of the other end of the screw part to provide a recess receiving a projecting end of a center shaft, the ends of the tube of each screw part being formed to provide a driving connection.

13. A track member for use in constructing a trackway for a toy of the rolling-ball type in which a ball rolls down the trackway from an elevated position at an upper level to a terminal position at a lower level, said track member being adapted to provide for a change in slope at a selected point along the trackway and comprising a first and a second track each comprising an elongate molded plastic member generally of V-shape in transverse cross section having a bottom rail extending the length thereof at the bottom for rolling of a ball thereon, sides extending up from said bottom rail diverging in upward direction, and upper rails extending the length thereof at the upper edges of the sides thereof, each track having first and second ends, the upper rails of each track projecting beyond the ends of the bottom rail thereof at the first end of the track, and said tracks being pivotally interconnected end-to-end at the ends of the upper rails for swinging movement about an axis extending transversely with respect to the tracks, a flexible member constituted by a strap extending between the bottom rails of the two tracks at said first ends thereof bridging the space therebetween, said flexible bridge member being slidably mounted on at least one of the bottom rails, and means at the second end of each track for quick interconnection therewith of another track of said trackway, the bottom rails of each track being formed for quick connection thereof to a support therefor.

14. A track member for use in constructing a trackway for a toy of the rolling-ball type in which a ball rolls down the trackway from an elevated position at an upper level to a terminal position at a lower level, the ball being automatically returned from said terminal position to said elevated position, said track member comprising an elongate molded plastic member generally of V-shape in transverse cross-section having a rail extending the length thereof at the bottom for rolling of a ball thereon and sides extending up from the bottom diverging in upward direction, said member having a head at one end thereof constituting a free end, said head having a downwardly directed ball passage therein having an open lower end, a ball rolling down said member being directed through said passage to drop down from said free end, said head being of generally tubular form extending transversely with respect to said member and extending down from said member, said head in being tubular having said downwardly directed ball passage therein, said head having an opening for entry of a ball rolling down said member, said ball passage being open at its lower end, a ball rolling down said member entering said head via said entry opening and dropping through said passage and out of the lower end of said passage.

15. A switch for use in constructing a trackway for a toy of the rolling ball type in which a ball rolls down the trackway from an elevated position at an upper level to a terminal position at a lower level, the ball being automatically returned from said terminal position to said elevated position for successive descents of the ball down the trackway, said switch comprising a track member for connection at opposite ends thereof in the trackway, said track member having a bottom and sides extending up generally vertically from the bottom, an elongate ramp-forming member pivoted for swinging movement generally midway of its length in a generally vertical plane between said vertical sides on a generally horizontal axis extending transversely between said vertical sides above said bottom, that part of the ramp-forming member extending in one direction from said axis forming a first ramp and that part of the ramp-forming member extending in the opposite direction from said axis forming a second ramp, said ramp-forming member having a vane extending up generally at right angles thereto in a plane including said axis, said ramp-forming member being swingable on said axis between a first position wherein the ramp-forming member slants down in a first direction toward one end of said track member, and a second position wherein the ramp-forming member slants down in the opposite direction toward the other end of said track member, a ball dropping down between the vane and the second ramp when the ramp-forming member is in the first position acting to swing the ramp-forming member to the second position so that the ball rolls down the second ramp in said opposite direction, and a ball dropping down between the vane and the first ramp when the ramp-forming member is in the second position acting to swing the ramp-forming member to the first position so that the ball rolls down the first ramp in said one direction.

16. A switch as set forth in claim 15 wherein the ramp-forming member is operated by a ball rolling thereon and directs the ball to travel in alternate directions on the track member on successive operations by the ball.

* * * * *